US007109440B2

(12) United States Patent
Lee

(10) Patent No.: US 7,109,440 B2
(45) Date of Patent: Sep. 19, 2006

(54) FUSING SYSTEM OF IMAGE FORMING APPARATUS AND TEMPERATURE CONTROL METHOD THEREOF

(75) Inventor: Beom-ro Lee, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 71 days.

(21) Appl. No.: 10/941,945

(22) Filed: Sep. 16, 2004

(65) Prior Publication Data

US 2005/0103770 A1 May 19, 2005

(30) Foreign Application Priority Data

Nov. 17, 2003 (KR) ..... 2003-81155

(51) Int. Cl.
*G03G 15/20* (2006.01)
*H05B 7/02* (2006.01)

(52) U.S. Cl. ..... 219/216; 399/69; 219/492; 219/494

(58) Field of Classification Search ..... None
See application file for complete search history.

(56) References Cited

U.S. PATENT DOCUMENTS 3,916,146 A * 10/1975 Hutner ..... 219/216
4,740,671 A * 4/1988 Kuroda et al. ..... 219/492
5,225,874 A * 7/1993 Koh et al. ..... 399/69
5,504,567 A 4/1996 Satoh et al.
5,682,576 A * 10/1997 Sakai et al. ..... 399/69
5,750,961 A * 5/1998 Schug et al. ..... 219/497
2002/0106211 A1* 8/2002 Suzuki et al. ..... 399/69

FOREIGN PATENT DOCUMENTS

JP 5-53656 3/1993
JP 5-289574 11/1993
JP 8-185080 7/1996
JP 8-220925 8/1996
JP 08220925 A * 8/1996

* cited by examiner

*Primary Examiner*—Joseph Pelham
(74) *Attorney, Agent, or Firm*—Staas & Halsey LLP

(57) ABSTRACT

A fusing system for use in an image forming apparatus has a fusing temperature control unit having a controller which controls the surface temperature 'T' of the fusing roller by detecting the surface temperature 'T' in accordance with a predetermined temperature control period '$t_0$'; comparing the surface temperature 'T' with a preset target temperature 'Tt'; turning on and off the heater in accordance with a maximum power supply time 'Max ON-time' and a minimum power cutoff time 'Min OFF-time' when the surface temperature 'T' is lower than the target temperature 'Tt'; and turning on and off the heater in accordance with a preset minimum power supply time 'Min ON-time' when the surface temperature 'T' is higher than the target temperature 'Tt'.

41 Claims, 10 Drawing Sheets

FUSING SYSTEM OF IMAGE FORMING APPARATUS AND TEMPERATURE CONTROL METHOD THEREOF

CROSS-REFERENCE TO RELATED APPLICATIONS

This application claims the benefit of Korean Patent Application No. 2003-81155 filed Nov. 17, 2003, in the Korean Intellectual Property Office, the disclosure of which is incorporated herein by reference.

BACKGROUND OF THE INVENTION

1. Field of the Invention

The present invention relates to a fusing system of an image forming apparatus such as a laser printer, a facsimile machine or a copier, and a temperature control method thereof. More particularly, the present invention relates to a fusing system of an image forming apparatus and a temperature control method thereof, which provide stable fusing of an image on a recording medium such as a paper by minimizing the temperature change of the surface of a fusing roller of a fusing unit of the image forming apparatus.

2. Description of the Related Art

A general electrophotographic image forming apparatus such as a copier or a laser printer prints images on a recording medium such as a paper sheet by a series of processes. These processes include an electrifying process which charges the surface of a photosensitive drum with a predetermined electric potential by rotating an electrostatic charging roller near the photosensitive drum. Other processes are a light exposure process which irradiates laser beams from a laser scanning unit (LSU) onto the surface of the photosensitive drum, thereby forming a desired electrostatic latent image and a developing process which develops the latent image on the photosensitive drum into a visible toner image by use of powder toner. Still another process is a transfer process which transfers the toner image of the photosensitive drum onto a paper sheet passing through the photosensitive drum and the transfer roller contacting the photosensitive drum with a predetermined pressure, by applying a predetermined transfer voltage to the photosensitive drum. Another process is a fusing process which fuses the toner image to the paper sheet by heating the paper sheet through a fusing unit which includes a fusing roller.

For the fusing process, a heater such as a halogen lamp is generally used, while being mounted inside the fusing roller and/or the fusing backup roller. Accordingly, the surface of the fusing roller is heated to a predetermined temperature by the radiant heat from the heater. Referring to FIG. 1, a fusing system 10 of an electrophotographic portion of a conventional image forming apparatus is described. A conventional fusing system 10 generally includes a cylindrical fusing roller 11 and a halogen lamp 12 mounted approximately at the center of the inside of the fusing roller 11. The halogen lamp 12 generates heat from within the fusing roller 11, and therefore, the fusing roller 11 is heated by the radiant heat from the halogen lamp 12.

A fusing backup roller 13 is mounted at the lower part of the fusing roller 11. As shown in FIG. 3, the fusing backup roller 13 is elastically supported by a spring device 13*a* to urge a paper sheet 14 passing between the fusing roller 11 and the fusing backup roller 13 toward the fusing roller 11.

Accordingly, a powder toner image 14*a* formed on the paper sheet 14 is pressed and heated by the pressure and heat while it is passed through the fusing roller 11 and the fusing backup roller 13. As a result, the powder toner image 14*a* is melted onto the paper sheet 14 by the heat and pressure applied from the fusing roller 11 and the fusing backup roller 13.

The fusing roller 11 has a thermistor 15 to detect the surface temperature of the fusing roller 11 in the form of an electric signal, a thermostat 16 to cut off a power supply to the halogen lamp 12 when the surface temperature of the fusing roller 11 exceeds a predetermined threshold, and a power switching part 19 (FIG. 1) such as a thyistor to switch a power supply of an AC power source 18 to the halogen lamp 12 in accordance with the signal received from a controller 20.

The thermistor 15 detects and transmits the surface temperature of the fusing roller 11 to the controller 20, and the controller 20 controls the power supply to the halogen lamp 12 through the power switching part 19 by comparing the detected temperature with a predetermined reference temperature, and thereby controls the surface temperature of the fusing roller 11 to a certain temperature suitable to fuse the image on the paper sheet 14.

The controller 20 generally uses a temperature control process which includes an initial heating stage in which the surface of the fusing roller 11 is heated to a print standby temperature (such as 165° C.), and a print standby stage in which the image forming apparatus waits for the print command while maintaining the surface temperature of the fusing roller 11 at the print standby temperature. The temperature control process also includes a print stage in which, with the input of a print command, the surface temperature of the fusing roller 11 is maintained higher than the print standby temperature in consideration of heat loss at the time of the fusing operation.

Referring to FIG. 4, in each of the temperature control stages, the controller 20 controls the power supply to the halogen lamp 12 to be on or off to maintain the surface temperature of the fusing roller 11 within a predetermined temperature range.

The on/off control by the controller 20 determines whether the current time 't' has exceeded a predetermined temperature control period '$t_0$' (S1). If so, the controller 20 reads the surface temperature 'T' of the fusing roller 11, which is detected through the thermistor 15 and compares the read temperature 'T' with a predetermined target temperature 'Tt' in operation (S2). If the surface temperature 'T' is lower than the predetermined target temperature 'Tt', power is supplied to the halogen lamp 12 from the AC power source 18 to turn on the halogen lamp 12 (S3), and if the surface temperature 'T' is higher than the predetermined target temperature 'Tt', a power supply from the AC power source 18 is cut off so that the halogen lamp 12 is turned off (S4).

The thermostat 16 operates as an overheat prevention unit to protect neighboring components and the fusing roller 11 from unexpected temperature change when the temperature control by the thermistor 15 and the controller 20 fail s.

Because the conventional fusing system 10 controls the halogen lamp 12 by on/off control, the surface temperature of the fusing roller 11 is, irrespective of certain circumstances and conditions, controlled either by print standby temperature or in print temperature. This approach increases the surface temperature of the fusing roller 11 to the print standby temperature rapidly in the initial heating stage (S1). However, after reaching the print standby temperature, the surface temperature of the fusing roller 11 changes greatly and problems such as over-shoot are experienced. Additionally, power supply to the halogen lamp 12 is not optimized, and power consumption thereby increases.

When the surface temperature of the fusing roller 11 changes greatly, print temperature cannot be controlled in stable manner. As a result, image fusing on the paper becomes unstable.

FIG. 5 shows proportional integral derivative (PID) control in the respective temperature control stages intended to overcome the above-mentioned problems. The PID control keeps the surface temperature of the fusing roller 11 within a predetermined temperature range by controlling the power supply to the halogen lamp 12.

In the PID control, the controller 20 determines whether the current time 't' has exceeded the predetermined temperature control period '$t_0$' (S1'). If so, the controller reads out the surface temperature 'T' of the fusing roller 11, which is detected through the thermistor 15 and compares the read temperature with a predetermined target temperature 'Tt' (S2'). If the detected surface temperature 'T' is lower than the target temperature 'Tt', the controller calculates a lamp "on time" in accordance with the equation (1) below. In operation S3', the controller turns on the halogen lamp 12 by supplying power to the halogen lamp 12 from the AC power source 18 (S4' and S5'). If the detected surface temperature 'T' is higher than the target temperature 'Tt', the controller turns off the halogen lamp 12 (S6').

$$\text{On time}(ms)=t_0 x \alpha_0 x(Tt-T)/100 \quad (1)$$

where, $\alpha_0$ is a proportional coefficient.

The PID control is advantageous as compared to the on/off control when considering a stable temperature control with little over shoot. However, according to the PID control, the temperature control period '$t_0$' must be shorter.

Meanwhile, the fusing roller 11 of the conventional fusing system 10 is generally formed as an aluminum cylinder which has a rubber layer 11*a* of lower heat conductivity formed around the outer surface (see FIG. 2).

The rubber layer 11*a* keeps a uniform contact area between the fusing roller 11 and the fusing backup roller 13 (a so-called 'nip area') when the paper sheet 14 is passed therethrough such that a sufficient time is given for the heat transfer to the paper sheet 14. Additionally, the rubber layer 11*a* keeps the heat supplied from the halogen lamp 12 such that the surface temperature of the fusing roller 11 is prevented from dropping abruptly when the paper sheet 14 is passed therethrough. However, due to its low heat conductivity, the rubber layer 11*a* of the fusing roller 11 requires more time for the heat transfer from the halogen lamp 12.

To describe the above in more detail, FIG. 6 shows one example of temperature distribution of the fusing roller 11 measured upon activation of the halogen lamp 12 and varying with time. As shown in FIG. 6, temperature does not vary much along the entire thickness of the aluminum cylinder, but toward the outer surface where the rubber layer 11*a* is located, temperature decreases due to low heat conductivity.

More specifically, approximately 90 seconds after the switch-on of the halogen lamp 12, the temperature of the aluminum cylinder of the fusing roller 11 stays at approximately 230° C. At this time, the rubber layer 11*a* has the temperature at approximately 180° C., which is 50° C. lower than the temperature of the aluminum cylinder. Accordingly, if the halogen lamp 12 is turned off when the surface temperature of the rubber layer 11*a* of the fusing roller 11 reaches the fusing temperature such as 180° C., the surface temperature of the rubber layer 11*a* rises beyond the fusing temperature due to the temperature of the aluminum cylinder, which has already been heated to 230° C. On the contrary, if the halogen lamp 12 is turned on when the surface temperature of the aluminum cylinder of the fusing roller 11, which is further increased over the fusing temperature due to the heat of the aluminum cylinder of the fusing roller 11, is cooled below the fusing temperature, the surface temperature of the rubber layer 11*a* keeps dropping until the heat applied to the aluminum cylinder of the fusing roller 11 is transmitted to the surface of the rubber layer 11*a*.

As described above, while the fusing roller 11 having the rubber layer 11*a* does not suffer abrupt temperature change due to the low heat conductivity of the rubber layer 11*a*, due to a rather great difference in conductivity between the rubber layer 11*a* and the aluminum cylinder, the temperature gap therebetween grows as the halogen lamp 12 is frequently turned on and off, or driven for a long period of time.

Additionally, considering that the paper sheet absorbs the heat of the surface of the fusing roller 11 when the paper sheet is fed to the fusing roller 11 of the fusing system 10, the temperature gap between the aluminum cylinder and the rubber layer 11*a* is widened.

As the temperature gap between the aluminum cylinder and the rubber layer 11*a* grows, the change in the surface temperature of the fusing roller 11 increases, subsequently causing an overshoot phenomenon. As a result, the fusing temperature cannot be controlled stably, and the image is unstably fused onto the paper sheet.

SUMMARY OF THE INVENTION

Accordingly, it is an aspect of the present invention to solve the above drawbacks and/or other problems associated with the conventional arrangement.

It is another aspect of the present invention to provide a fusing system of an image forming apparatus capable of stably controlling the surface temperature of the fusing roller by minimizing the surface temperature change of the fusing roller, and also optimizing power supply to a heater, and a temperature control method thereof.

It is another aspect of the present invention to provide a fusing system of an image forming apparatus capable of preventing a low temperature fusing problem, especially when waiting for the next printing or for the next data transmission for a relatively long period of time during the printing operation, and a temperature control method thereof.

It is yet another aspect of the present invention to provide a fusing system of an image forming apparatus capable of optimizing power supply to a heater while reducing temperature irregularities on the surface of the fusing roller by controlling the surface temperature of the fusing roller according to a relatively long temperature control period, and a temperature control method thereof.

Additional aspects and/or advantages of the invention will be set forth in part in the description which follows and, in part, will be obvious from the description, or may be learned by practice of the invention.

The foregoing and/or other aspects of the present invention are achieved by providing a fusing system for use in an image forming apparatus, including: a fusing unit including a fusing roller, and a heater, mounted inside the fusing roller, to heat the fusing roller; and a fusing temperature control unit. The fusing temperature control unit includes a sensor unit to sense a surface temperature 'T' of the fusing roller, a power supply unit to supply power to the heater, a controller including a timer to count time, and a memory to store therein a preset target temperature 'Tt' for a surface of the fusing roller, a preset temperature control period '$t_0$' to determine a heater on and off time, a preset maximum power supply time 'Max ON-time' and a minimum power supply time 'Min ON-time' during which the power supply unit supply power to the heater, and a minimum power cutoff time 'Min OFF-time' during which the power supply unit can cut off the power supply to the controller to control the surface temperature 'T' of the fusing roller by a control of the power supply to the heater in accordance with the target temperature 'Tt', the temperature control period '$t_0$', the 'Max ON-time', the 'Min ON-time' or the 'Min OFF-time'.

The controller controls the heater to turn on and off in accordance with the 'Max ON-time' and the 'Min OFF-time' in each of the temperature control periods '$t_0$' before the surface temperature 'T' of the fusing roller reaches the target temperature 'Tt', and controls the heater to turn on and off in accordance with the 'Min ON-time' in each of the temperature control periods '$t_0$' after the surface temperature 'T' of the fusing roller reaches the target temperature 'Tt'.

The 'Min On-time' may be set to correspond to a heater power supply time or shorter, during which the power supply unit has to supply power in every temperature control period '$t_0$', or a longer period (for example, the sum of the 'Min ON-time' and the 'Min OFF-time') to heat the fusing roller to the target temperature 'Tt', and then maintain the target temperature 'Tt' under various conditions. Power is supplied to the heater for the duration of the 'Min ON-time' in accordance with a certain time period, and therefore, temperature can be stably maintained between the aluminum cylinder and the rubber layer.

Alternatively, the 'Min ON-time' may be set to a heater power supply time of the power supply unit or shorter, which is required to compensate for a temperature drop during a paper feeding period which is set to be longer than the temperature control period '$t_0$'.

The temperature control period '$t_0$' may be set to correspond to the 'Min OFF-time' or the 'Min ON-time', whichever is smaller, or a value smaller than both of the 'Min OFF-time' and the 'Min ON-time'. Particularly, the temperature control period '$t_0$' may be set to: a common divisor of the 'Min OFF-time' and the 'Min ON-time'; a divisor of the paper feeding period and the 'Min OFF-time' or the 'Min ON-time', whichever is smaller, or the value smaller than both of the 'Min OFF-time' and the 'Min ON-time'; or a common divisor of the 'Min OFF-time', the 'Min ON-time' and the paper feeding period. If the temperature control period '$t_0$' is too small, the 'Min OFF-time' and the 'Min ON-time' may be appropriately adjusted to change the temperature control period '$t_0$' to an appropriate value.

The controller controls the heater to turn off, irrespective of the 'Min ON-time', after the surface temperature 'T' reaches the target temperature 'Tt' and when the surface temperature 'T' exceeds a preset temperature limit 'T_lim'.

The 'Min OFF-time' guarantees a certain period of time after the power-on of the heater, during which the heat from the heater reaches the surface of the fusing roller and influences the surface temperature 'T' thereof. The 'Min OFF-time' is set to the time duration spanning from the power-on of the heater to, or within the time when the surface temperature 'T' starts to rise.

If the paper feeding period is shorter than the duration spanning from the power-on of the heater to approximately the time when the surface temperature 'T' starts to rise, the 'Min OFF-time' is set to correspond to the paper feeding period or shorter.

The 'Max ON-time' functions, so that even when the surface temperature 'T' of the fusing roller is lower than the target temperature 'Tt', power supply to the heater is cut off when a certain time period lapses after the power-on. The power supply is resumed, when the surface temperature 'T' is lower than the target temperature 'Tt' after the 'Min OFF-time'. By doing so, the temperature gap between the aluminum cylinder and the surface temperature 'T' of the fusing roller can be minimized, and therefore, the possibility of having overshoot phenomenon can be avoided when reaching the surface temperature 'T' of the fusing roller. The 'Max ON-time' is determined according to the desired temperature rise with one-time power supply to the heater. For example, if the desired temperature rise is 15° C., and it takes 10 seconds to increase the temperature to 15° C., the 'Max ON-time' will be 10 seconds.

Alternatively, a memory of the fusing system may further store therein at least one 'Max OFF-time' during which the power supply to the heater can be cut off once. The 'Max OFF-time' prevents the temperature of the aluminum cylinder from decreasing far below the surface temperature 'T' when the power is not supplied to the heater for a certain period of time. If the 'Max OFF-time' is applied, the controller turns on and off the heater in accordance with the 'Min ON-time' and the 'Max OFF-time' in every temperature control period '$t_0$' after the surface temperature 'T' reaches the target temperature 'Tt'. The controller controls the heater to turn off, irrespective of the 'Min ON-time' and the 'Max OFF-time', when the surface temperature 'T' reaches the target temperature 'Tt' and exceeds a preset temperature limit 'T_lim'.

The controller may also control the surface temperature 'T' in accordance with a plurality of control processes, each of which uses at least five elements from among the temperature control period '$t_0$', the target temperature 'Tt', the 'Max ON-time', the 'Min ON-time', the 'Min OFF-time' and the 'Max OFF-time'.

The foregoing and/or other aspects of the present invention may also be achieved by providing a temperature control method of a fusing system for use in an image forming apparatus which includes a fusing roller and a heater to heat the fusing roller, the method including detecting a surface temperature 'T' of the fusing roller in accordance with a temperature control period '$t_0$'; comparing the surface temperature 'T' with a preset target temperature 'Tt'; and turning the heater on and off in accordance with the comparing, in accordance with a maximum power supply time 'Max ON-time', a minimum power cutoff time 'Min OFF-time' or a minimum power supply time 'Min ON-time'.

According to one aspect of the present invention, the turning on and off of the heater may include: turning on and off the heater in accordance with the 'Max ON-time' and the 'Min OFF-time' when the surface temperature 'T' is lower than the target temperature 'Tt'; and turning on and off the heater in accordance with the 'Min ON-time' when the surface temperature 'T' is higher than the target temperature 'Tt'.

The turning on and off of the heater in accordance with the 'Max ON-time' and the 'Min OFF-time' may include: comparing a heater power supply time with the 'Max ON-time'; turning off the heater when the heater power supply time exceeds the 'Max ON-time'; comparing a heater power cutoff time with the 'Min OFF-time'; and cutting off the heater power supply when the heater power cutoff time does not exceed the 'Min OFF-time'.

The turning on and off of the heater according to the 'Min ON-time' may include: comparing a heater power supply time with the 'Min ON-time'; and supplying power to the heater when a heater power supply time does not exceed the 'Min ON-time'.

The 'Min On-time' may be set to correspond to a heater power supply time or shorter, during which the power should be supplied in every temperature control period '$t_0$', or to a longer period (for example, the sum of the 'Min ON-time' and the 'Min OFF-time') to maintain the target temperature 'Tt'.

The 'Min ON-time' may be set to a heater power supply time or shorter, which is required to compensate for a temperature drop during a paper feeding period, which is set to be longer than the temperature control period '$t_0$'.

The temperature control period '$t_0$' may be set to: the 'Min OFF-time' or the 'Min ON-time', whichever is smaller, or a value smaller than both of the 'Min OFF-time' and the 'Min ON-time'. Particularly, the temperature control period '$t_0$' may be set to a common divisor of the 'Min OFF-time' and the 'Min ON-time'; a divisor of a paper feeding period and the 'Min OFF-time' or the 'Min ON-time', whichever is smaller, or the value smaller than both of the 'Min OFF-time' and the 'Min ON-time'; or a common divisor of the 'Min OFF-time', the 'Min ON-time' and the paper feeding period.

The supplying of the power to the heater when the heater power supply time does not exceed the 'Min ON-time' may include: determining whether the surface temperature 'T' of the fusing roller exceeds a preset temperature limit 'T_lim'; and cutting off the power supply to the heater when the surface temperature 'T' exceeds the 'T_lim', even if the 'Min ON-time' has not elapsed yet.

The turning on and off of the heater in accordance with the 'Min ON-time' may include: comparing the heater power supply time with the 'Min ON-time'; supplying power to the heater when the heater power supply time does not exceed the 'Min ON-time'; comparing the heater power cutoff time with a preset maximum power cutoff time 'Max OFF-time' when the heater power supply time exceeds the 'Min ON-time'; and supplying power to the heater when the heater power cutoff time exceeds the 'Max OFF-time'.

The supplying of power to the heater when the heater power cutoff time exceeds the 'Max OFF-time' may include: comparing the surface temperature 'T' of the fusing roller with a preset temperature limit 'T_lim'; and cutting off the power supply to the heater when the surface temperature 'T' exceeds the 'T_lim'.

The fusing roller may include a rubber layer of a thickness on the surface such that the surface temperature 'T' increases when a time lapses after the power supply unit supplies the power to the heater. The 'Min OFF-time' may be set to a value, and the set value corresponds to a time from the supply of power to the heater to, or within the time when the surface temperature 'T' begins to rise. Additionally, the 'Min OFF-time' corresponds to the paper feeding period or shorter, when the paper feeding period is shorter than the duration between the turn-on of the heater and the increase of surface temperature 'T'.

The foregoing and/or other aspects of the present invention are also achieved by providing a temperature control method of a fusing system for use in an image forming apparatus which includes a fusing roller and a heater to heat the fusing roller, the method including: increasing a surface temperature 'T' of the fusing roller to a preset target temperature 'Tt'; maintaining the surface temperature 'T' at the target temperature 'Tt', wherein the increasing of the surface temperature 'T' to the target temperature 'Tt' includes, detecting the surface temperature 'T' according to a first predetermined temperature control period '$t_{01}$', comparing the detected surface temperature 'T' with a first temperature 'T1' which is equal to or higher than the target temperature 'Tt', turning on and off the heater in accordance with a first maximum power supply time 'Max ON-time1' and a first minimum power cutoff time 'Min OFF-time1' when the detected surface temperature 'T' is lower than the first temperature 'T1', turning on and off the heater in accordance with a first minimum power supply time 'Min ON-time1' and maintaining the surface temperature 'T' at the target temperature 'Tt' when the detected surface temperature 'T' is higher than the first temperature 'T1'.

The turning on and off of the heater in accordance with the 'Max ON-time1' and the 'Min OFF-time1' includes comparing a heater power supply time with the 'Max ON-time1'; turning off the heater when the heater power supply time exceeds the 'Max ON-time1'; comparing a heater power cutoff time with the 'Min OFF-time1'; and cutting off the power supply to the heater when the heater power cutoff time does not exceed the 'Min OFF-time1'.

The turning on and off of the heater in accordance with the 'Min ON-time1' may include: comparing the heater power supply time with the 'Min ON-time1'; and supplying power to the heater when the heater power supply time does not exceed the 'Min ON-time1'.

The supplying of the power to the heater when the heater power supply time does not exceed the 'Min ON-time1' may further include determining whether the surface temperature 'T' of the fusing roller exceeds a preset temperature limit 'T_lim'; and cutting off the power supply to the heater if the surface temperature 'T' exceeds 'T_lim', irrespective of whether the 'Min On-time1' has elapsed.

The maintaining of the surface temperature 'T' at the target temperature 'Tt', may include: detecting the surface temperature 'T' in accordance with a second temperature control period '$t_{02}$'; comparing the detected surface temperature 'T' with the target temperature 'Tt'; turning on and off the heater in accordance with a second maximum power supply time 'Max ON-time2' and a second minimum power cutoff time 'Min OFF-time2' when the surface temperature 'T' is lower than the target temperature 'Tt'; and turning on and off the heater in accordance with a second minimum power supply time 'Min ON-time2' when the surface temperature 'T' of the fusing roller is higher than the target temperature 'Tt'.

The turning on and off of the heater in accordance with the 'Max ON-time2' and the 'Min OFF-time2' may include: comparing a heater power supply time with the 'Max ON-time2'; turning off the heater when the heater power supply time exceeds the 'Max ON-time2'; comparing a heater power cutoff time with the 'Min OFF-time2'; and cutting off the power supply to the heater when the heater power cutoff time does not exceed the 'Min OFF-time2'.

The turning on and off of the heater in accordance with the 'Min ON-time2' may include: comparing the heater power supply time with the 'Min ON-time2'; and supplying power to the heater when the heater power supply time does not exceed the 'Min ON-time2'.

The supplying of the power to the heater when the heater power supply time does not exceed the 'Min ON-time2', may include: determining whether the surface temperature 'T' exceeds a temperature limit 'T_lim'; and cutting off the power supply to the heater if the surface temperature 'T' exceeds 'T_lim', irrespective of whether the 'Min ON-time2' is elapsed.

The 'Min On-time2' may correspond to a heater power supply time or shorter, during which the power should be supplied in every second temperature control period '$t_{02}$', or a longer period (for example, the sum of the 'Min ON-time2' and the 'Min OFF-time2') to maintain the target temperature 'Tt' under various environments.

Alternatively, the 'Min ON-time2' may be set to a heater power supply time or shorter, which is required to compensate for a temperature drop during a paper feeding period, if the paper feeding period is longer than the second temperature control period '$t_{02}$'.

The 'Min ON-time1' and the 'Min ON-time2' may be identical with each other.

Alternatively, the turning on and off of the heater in accordance with the 'Min ON-time2' may include: comparing the heater power supply time with the 'Min ON-time2'; constantly supplying power to the heater when the heater power supply time does not exceed the 'Min ON-time2'; comparing the heater power cutoff time with a maximum power cutoff time 'Max OFF-time' when the heater power supply time exceeds the 'Min ON-time2'; and supplying power to the heater when the heater power cutoff time exceeds the 'Max OFF-time2'.

The supplying of the power to the heater when the heater power cutoff time exceeds the 'Max OFF-time' may further include: comparing the surface temperature 'T' of the fusing roller with a temperature limit 'T_lim'; and cutting off the power to the heater when the surface temperature 'T' exceeds 'T_lim'.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
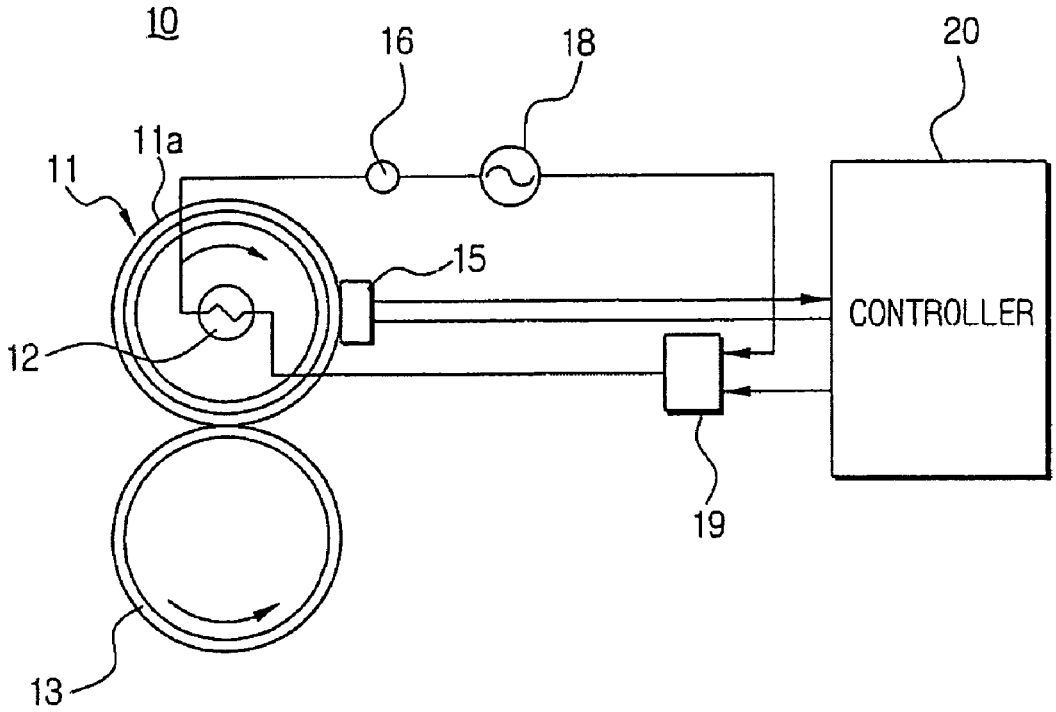
FIG. 1 (PRIOR ART)
FIG. 1 is a schematic view of a conventional fusing system of an electrophotographic image forming apparatus.

Reference will now be made in detail to the embodiments of the present invention, examples of which are illustrated in the accompanying drawings, wherein like reference numerals refer to the like elements throughout. The embodiments are described below to explain the present invention by referring to the figures.

Embodiment 1

Figure 7:
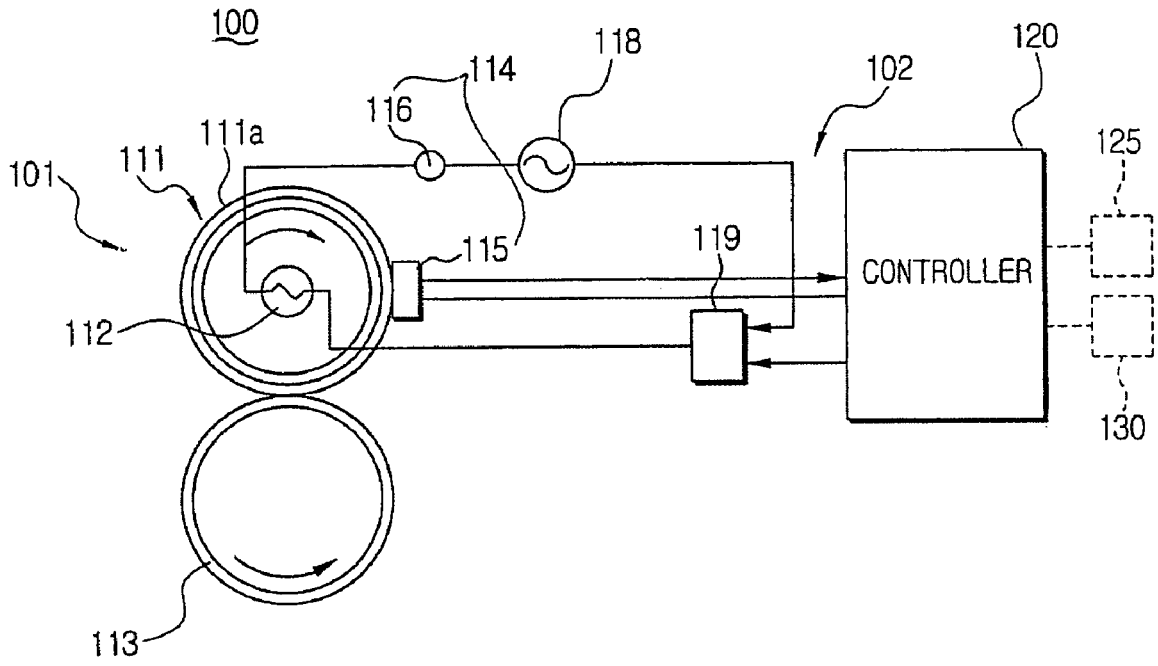
FIG. 7 is a schematic view of a fusing system of an image forming apparatus according to a first embodiment of the present invention.

FIG. 7 shows a fusing system 100 according to a first embodiment of the present invention, which is mainly applied to an electrophotographic image forming apparatus such as a laser printer, copier or facsimile machine.

The fusing system 100 includes a fusing unit 101 and a fusing temperature control unit 102. The fusing unit 101 has a fusing roller 111 to melt a toner image onto a paper sheet (not shown) with heat and pressure. The fusing temperature control unit 102 controls the driving of a heater 112 in accordance with various variables. These variables include a predetermined target surface temperature 'Tt', such as a printing standby temperature of approximately 165° C. or a printing temperature of approximately of 180° C., to heat the surface of the fusing roller 111 in a fusing operation; a predetermined temperature control period '$t_0$' to determine whether to switch on/off the heater 112; a maximum power supply time 'Max ON-time' and a minimum power supply time 'Min ON-time' during which an AC power supply 118 supplies power to the heater 112; and a minimum power cutoff time 'Min OFF-time' and a maximum power cutoff time 'Max OFF-time' during which the AC power supply 118 can cut off the power to the heater 112.

The fusing unit 101 includes the fusing roller 111 which includes an aluminum cylinder body and a rubber belt or a rubber layer 111*a* wrapped around the aluminum cylinder body; a fusing backup roller 113 mounted to exert a predetermined pressure with respect to the fusing roller 111 from below; and the heater 112 such as a halogen lamp, which is mounted in the center of the fusing roller 111 and generates a fusing heat to fix a toner image to the paper sheet. To ensure that the fusing heat is sufficiently supplied and the paper sheet stays on the fusing roller 111 for a sufficient time, the fusing roller 111 may be constructed of an aluminum cylindrical roller wrapped with a rubber layer 111*a* of a predetermined thickness having a TEFLON™ (or other non-stick) coating layer or a TEFLON tubing formed at a surface thereof. Alternatively, the fusing roller 111 may be constructed to include an aluminum cylinder processed with TEFLON tubing, or coated with TEFLON. Although the fusing backup roller 113 is depicted as not having a heater in the present embodiment, one will appreciate that the heater may be adequately employed as a need arises.

The fusing temperature control unit 102 includes a sensor unit 114 having a thermistor 115 provided for the fusing roller 111 and operating to detect the surface temperature 'T' of the fusing roller 111, and a thermostat 116 to cut off the power supply to the heater 112 when the surface temperature 'T' of the fusing roller 111 exceeds a given threshold. The fusing temperature control unit 102 also includes the AC power supply 118 to supply power to the heater 112; a power switching unit 119 such as a thyristor to switch power of the AC power supply 118 to the heater 112; and a controller 120 to control the sensor unit 114 and the power switching unit 119.

Figure 2:
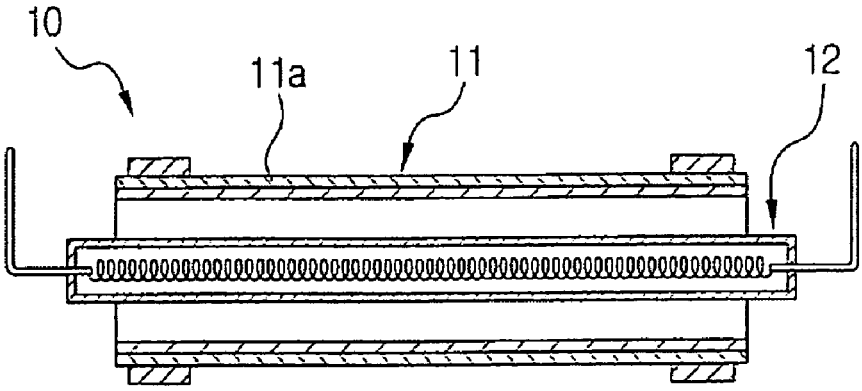
FIG. 2 (PRIOR ART)
FIG. 2 is a sectional view of a fusing roller and a heater of the fusing system of FIG. 1.
Figure 3:
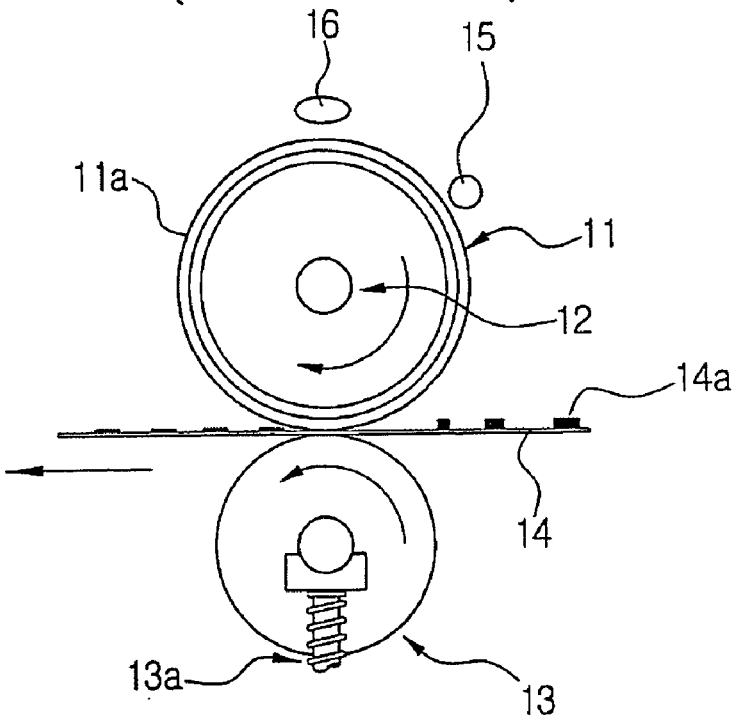
FIG. 3 (PRIOR ART)
FIG. 3 is a side view illustrating one example of a fusing operation of the fusing system of FIG. 1.
Figure 4:
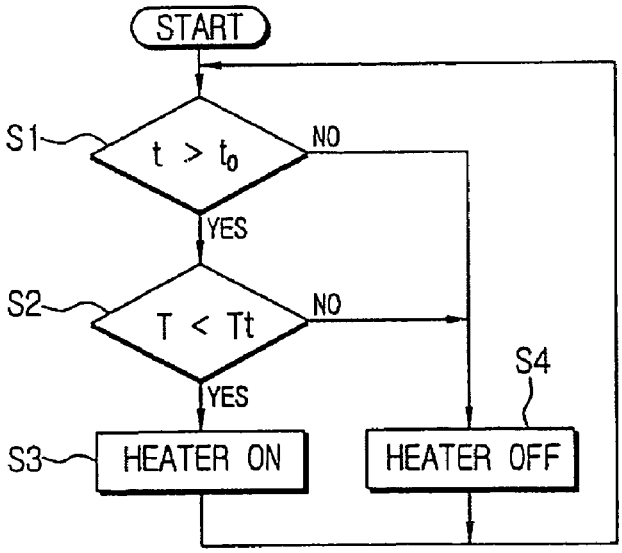
FIG. 4 (PRIOR ART)
FIG. 4 is a flowchart illustrating exemplary operations of a temperature control method of the fusing system of FIG. 1.
Figure 5:
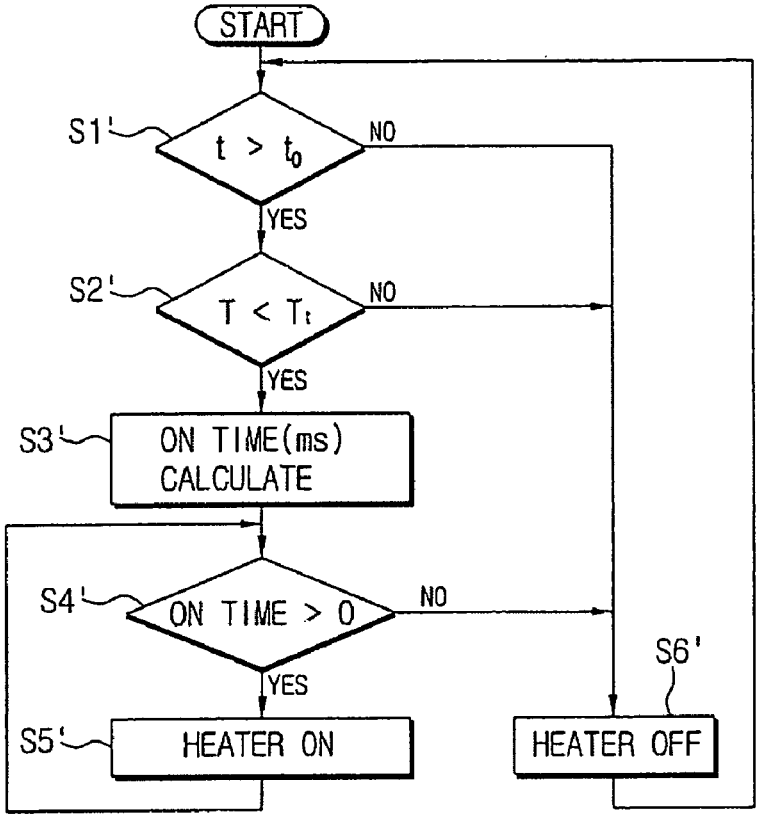
FIG. 5 (PRIOR ART)
FIG. 5 is a flowchart illustrating exemplary operations of another temperature control method applicable to the fusing system of FIG. 1.
Figure 6:
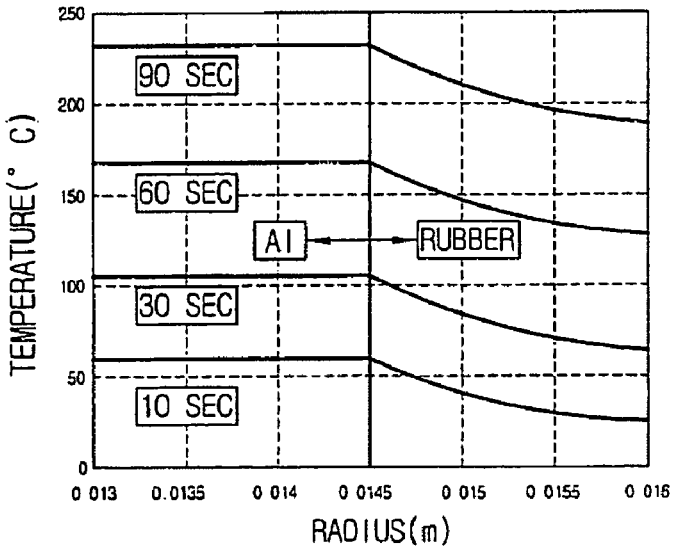
FIG. 6 (PRIOR ART)
FIG. 6 is a graph illustrating an example of temperature distribution per hour of a conventional fusing roller having a rubber layer formed thereon, which is applied to the fusing system of FIG. 1.

The fusing unit 101 and the fusing temperature control unit 102, excluding the controller 120, have a similar structure and operation as the fusing system 10 described with reference to FIGS. 1, 2 and 3. Accordingly, further description thereof will be omitted.

The controller 120 includes a timer 130 to count time, and a memory 125 to store information such as the target surface temperature 'Tt', the temperature control period '$t_0$', the maximum power supply time 'Max ON-time', the minimum power supply time 'Min ON-time' and the minimum power cutoff time 'Min OFF-time'.

The controller 120 controls such that the heater 112 is turned on and off in accordance with the 'Max ON-time' and the 'Min OFF-time' in every temperature control period '$t_0$' before the surface temperature 'T' of the fusing roller 111 detected by the thermistor 115 of the sensor unit 114 reaches the target temperature 'Tt', and the heater 112 is turned on and off in accordance with the 'Min ON-time' in every temperature control period '$t_0$' after the surface temperature 'T' of the fusing roller 111 reaches the target surface temperature 'Tt'.

To describe it in more detail, if the power supply period to the heater 112 exceeds the 'Max ON-time' when the surface temperature 'T' of the fusing roller 111 is lower than the target temperature 'Tt', power is not supplied to the heater 112 and instead the power supply to the heater 112 is cut off for the 'Min OFF-time'.

Accordingly, even when the surface temperature 'T' of the fusing roller 111 is lower than the target temperature 'Tt', the heater 112 is not constantly driven, but selectively turned on and off in accordance with the 'Max ON-time' or the 'Min OFF-time'. As a result, the temperature gap between the aluminum cylinder and the rubber layer 11*a* is restricted from exceeding a limit.

The 'Max ON-time' is decided by detecting temperature rising rate per time of the surface temperature 'T' of the fusing roller 111 and based on the temperature rising rate per time, and calculating a time period which corresponds to the temperature value required to increase the surface temperature 'T' of the fusing roller 111 with one-time supply of the AC power supply 118. More specifically, the 'Max ON-time' is decided based on the temperature increase rate which is obtained by measuring temperature rise per certain time unit. For example, if the temperature of the fusing roller 111 should be increased by 15° C. and power supply is required for approximately 10 seconds to increase the temperature by 15° C., the 'Max ON-time' is 10 seconds. However, if the temperature control period '$t_0$' is 0.9 seconds, the 'Max ON-time' is 9.9 seconds, which corresponds to a multiple of temperature control period '$t_0$'.

The 'Min OFF-time' is a time interval between when the power is supplied to the heater 112 and when the surface temperature 'T' of the fusing roller 111, i.e., the surface temperature of the rubber layer 111*a*, begins to increase.

When the surface temperature 'T' of the fusing roller 111 is greater than the target temperature 'Tt' and the power supply of the AC power supply 118 to the heater 112 does not exceed the 'Min ON-time', power is continuously supplied to the heater 112 for the duration which corresponds to the 'Min ON-time'.

The 'Min ON-time' is set to include a time during which the power should be supplied to the heater 112 in every certain period, for example, in every temperature control period '$t_0$' so that the surface temperature 'T' of the fusing roller 111 can maintain the temperature after it has reached the target temperature 'Tt'.

Accordingly, the 'Min ON-time' is set to the power supply time of the AC power supply 118 or lower as required to maintain the surface temperature 'T' at the target temperature 'Tt', in every temperature control period '$t_0$', or a longer cycle (for example, at every interval corresponding to the sum of the minimum power supply time 'Min ON-time' and the minimum power cutoff time 'Min OFF-time').

Alternatively, the 'Min ON-time' can be set to the heater power supply time of the AC power supply 118 or a shorter time period so as to compensate for the temperature drop during the power feeding period which usually takes longer than the temperature control period '$t_0$'.

The 'Min OFF-time' compensates for the time in which the heat of the heater 112, after the power supply to the heater 112 reaches the surface of the fusing roller 111, affecting the surface temperature 'T' of the fusing roller 111. Therefore, the 'Min OFF-time' is set to a time interval between when the AC power supply 118 starts power supply to the heater 112 and around, or within the time when the surface temperature 'T' begins to increase.

The 'Min OFF-time' or the 'Min ON-time', whichever is smaller, or a value smaller than either of the 'Min OFF-time' and 'Min ON-time', can be set as the temperature control period '$t_0$' in order to avoid a control-absent period between the temperature control periods '$t_0$'. Particularly, the temperature control period '$t_0$' may be set to a common divisor of the 'Min OFF-time' and the 'Min ON-time'; a divisor of the paper feeding period and the 'Min OFF-time' or the 'Min ON-time', whichever is smaller, or the value smaller than either of the 'Min OFF-time' and the 'Min ON-time'; or a common divisor of the 'Min OFF-time' and the 'Min ON-time' and the paper feeding period.

When the surface temperature 'T' of the fusing roller 111 reaches the target temperature 'Tt', the controller 120 controls the heater 112 to turn on in accordance with the 'Min ON-time', and in this process, the controller 120 may control the heater 112 to turn off irrespective of the 'Min ON-time' when the surface temperature 'T' of the fusing roller 111 exceeds a predetermined temperature limit 'T_lim', for example 195° C.

In the fusing system 100 according to the first exemplary embodiment of the present invention, the heater 112 is selectively turned on and off according to the 'Max ON-time' and the 'Min OFF-time' in every temperature control period '$t_0$', when the surface temperature 'T' of the fusing roller 111 is lower than the target temperature 'Tt' such that the temperature gap between the aluminum cylinder and the rubber layer 111*a* is restricted below a predetermined level and the temperature can rapidly reach an optimum printing temperature. Also, when the surface temperature 'T' of the fusing roller 111 is in the neighborhood of, or higher than the target temperature 'Tt', because the heater 112 is selectively turned on and off according to the 'Min ON-time' and 'T_lim' in every temperature control period '$t_0$', the temperature gap between the aluminum cylinder and the rubber layer 111*a* is restricted below a predetermined limit and the temperature can be maintained at the target temperature 'Tt'.

With the fusing system 100 according to the first embodiment of the present invention, the temperature gap between the aluminum cylinder and the rubber layer 111*a* is restricted to below a predetermined level. As a result, the possibility of having overshoot is prevented, and the surface temperature 'T' of the fusing roller 111 is maintained. In other words, the surface temperature 'T' of the fusing roller 111 is controlled to be stable, and power supply to the heater 112 is optimum.

The temperature control method of the fusing system 100 for use in an image forming apparatus which is constructed according to the first embodiment of the present invention will be described in detail with reference to FIG. 8.

Figure 8:
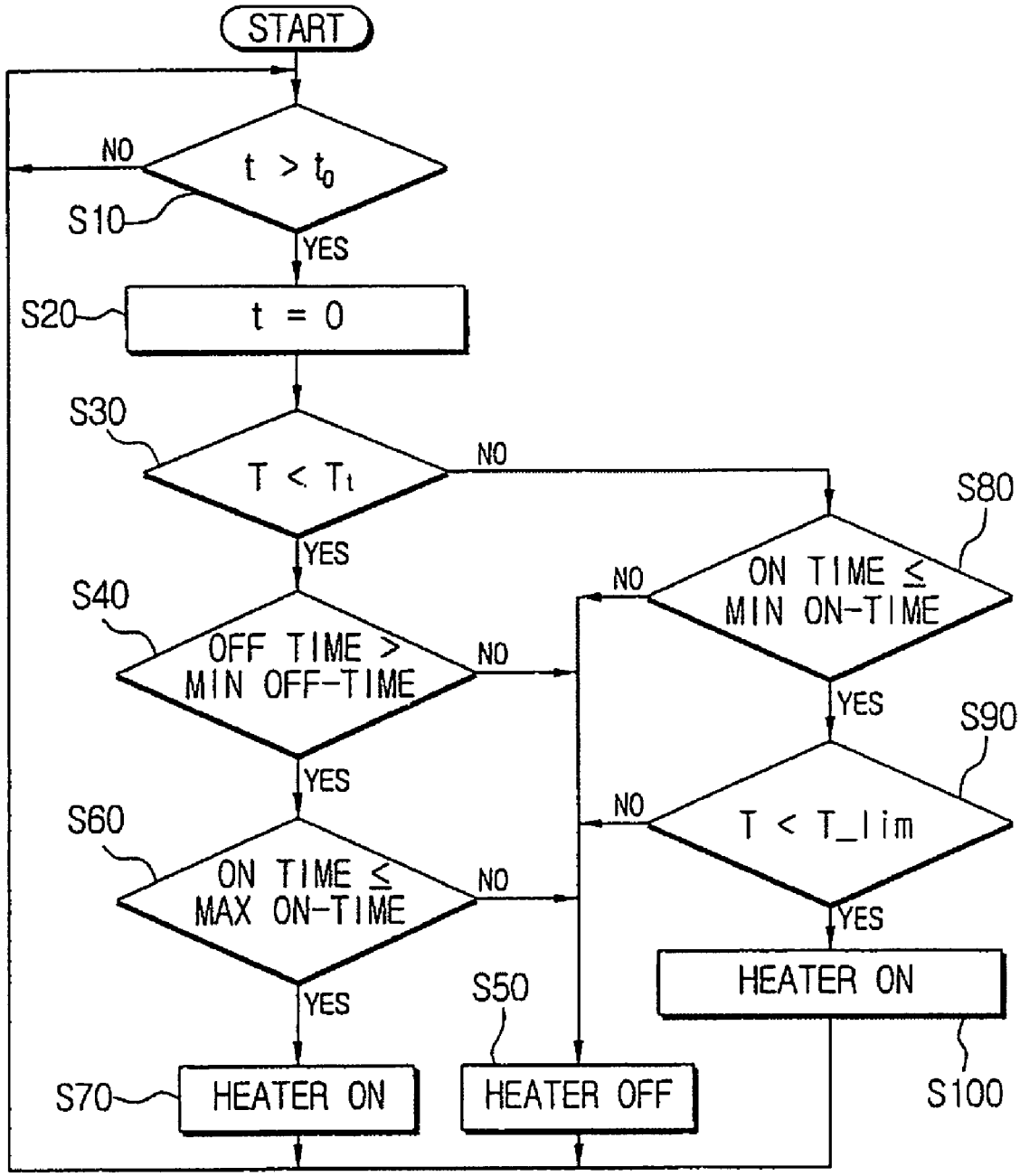
FIG. 8 is a flowchart illustrating exemplary operations of a temperature control method of the fusing system of FIG. 7.

Referring first to FIG. 8, when the power is supplied to the fusing system 100, the controller 120 determines whether the current time 't', which is counted through the timer 130, exceeds the temperature control period '$t_0$', and accordingly determines whether it is the temperature control period '$t_0$' stored in the memory 125 (S10).

If it is the temperature control period '$t_0$' as a result of the determination in S10, the controller 120 clears the current time 't' to '0', and re-starts time counting (S20). Next, the controller measures the surface temperature 'T' of the fusing roller 111 through the thermistor 115 of the sensor unit 114, to determine whether the surface temperature 'T' of the fusing roller 111 is lower than the target temperature 'Tt' (for example, approximately 180° C., the printing temperature in the present embodiment) (S30).

If the surface temperature 'T' of the fusing roller 111 is lower than the printing temperature 180° C. (the target temperature 'Tt') as a result of the determination in S30, the controller 120 determines whether a heater power cutoff time 'OFF time' is longer than the 'Min OFF-time' stored in the memory 125 (S40). The 'OFF time' refers to a duration in which the AC power supply 118 does not constantly supply power to the heater 112.

If the 'OFF time' is shorter than the 'Min OFF-time' as a result of the determination in S40, the controller 120 cuts off the power supply from the AC power supply 118 to the heater 112 (S50), and if the 'Off time' is longer than the 'Min OFF-time', the controller 120 determines whether the heater power supply time 'ON time' counted by the timer 130 is shorter than the 'Max ON-time' (S60).

If the 'ON time' is shorter than the 'Max ON-time' as a result of the determination in S60, the controller controls the AC power supply 118 to supply power to the heater 112 (S70), and if the 'ON time' is longer than the 'Max ON-time', the controller 120 cuts off power supply of the AC power supply 118 to the heater 112 (S50).

Accordingly, the power of the AC power supply 118 is supplied or cut off in the operation S70 or S50, and during this process, the controller 120 moves to operation S10 and waits for the current time 't', counted through the timer 130, to reach the temperature control period '$t_0$'.

If the surface temperature 'T' of the fusing roller 111 is higher than the target temperature 'Tt', i.e., the printing temperature of approximately 180° C., the controller 120 determines whether 'ON time' is shorter than 'Min ON-time' (S80).

If the 'ON time' is longer than the 'Min ON-time' as a result of the determination in S80, the controller 120 cuts off the power supply of the AC power supply 118 to the heater 112 (S50).

If the 'ON time' is shorter than the 'Min ON-time' as a result of the determination in S80, the controller 120 determines whether the surface temperature 'T' of the fusing roller 111 is lower than the maximum temperature limit (T_lim) (S90).

If the surface temperature 'T' of the fusing roller 111 is lower than '$T_{13}$ lim' as a result of the determination in S90, the controller 120 controls the AC power supply 118 to keep supplying power to the heater 112 (S100).

If the surface temperature 'T' of the fusing roller 111 is higher than 'T_lim' as a result of the determination in S90, the controller 120 cuts off the power supply of the AC power supply 118 to the heater 112 (S50).

While the AC power supply 118 supplies or cuts off power supply to the heater 112 in operation S100 or S50, the controller 120 moves to operation S10 and waits for the current time 't', counted through the timer 130, to reach the temperature control period '$t_0$'.

When the current time 't' reaches the temperature control period '$t_0$' in operation S10, the controller 120 repeats the remaining operations (S20–S100).

The timer 130 calculates the 'ON time' in which the AC power supply 118 constantly supplies power to the heater 112, and 'OFF time' in which the AC power supply 118 constantly cuts off the power supply to the heater 112, and clears the respective times to '0' when the heater power switches on or off. In other words, the 'OFF time' is cleared to '0' upon the power cutoff during the constant power supply to the heater 112, while the 'ON time' is cleared to '0' upon power supply to the heater 112 during the power cutoff.

Although the above embodiment depict s a particular example of the fusing system 100 and temperature control method thereof in which the surface temperature 'T' of the fusing roller 111 is controlled with reference to a single target temperature 'Tt' such as the printing temperature of approximately 180° C., this is only for illustrative purposes. Therefore, a variety of adequate examples are also applicable. For example, control can be performed based on two temperatures such as a printing standby temperature of approximately 165° C. and the printing temperature of approximately 180° C. In this example, the controller 120 may control the surface temperature 'T' of the fusing roller 111 in accordance with an initial heating operation of heating the surface temperature 'T' of the fusing roller 111 to the printing standby temperature of the suitable temperature near the printing temperature; a print standby operation of maintaining the surface temperature 'T' of the fusing roller 111 to the printing standby temperature; a heating operation of heating to increase the surface temperature 'T' of the fusing roller 111 to the printing temperature or slightly higher; and a printing operation of maintaining the surface temperature 'T' of the fusing roller 111 to the printing temperature. Information for the respective operations such as the temperature control period '$t_0$', the 'Max ON-time', the 'Min ON-time' and 'Min OFF-time' are stored in the memory 125 so that the controller 120 can control the surface temperature 'T' of the fusing roller 111 in the respective operations with the stored or approximate values.

Embodiment 2

The second embodiment of the present invention will now be described below, and because the fusing system 100 of the second embodiment is similar to the fusing system 100 of the first embodiment of FIG. 7, and differing only in the temperature control method adopted therein, the following description will generally pertain to the temperature control method.

The temperature control method of the fusing system 100 for use in an image forming apparatus according to the second embodiment of the present invention will be described below with reference to FIG. 9.

With the power supply to the fusing system 100, the controller 120 begins operations S10' through S130 in which the surface temperature 'T' of the fusing roller 111 is increased from the atmospheric temperature to the target temperature 'Tt' (such as the printing standby temperature of approximately 165° C. or the printing temperature of approximately of 180° C.). Operations S140 through S230 generally maintain the surface temperature 'T' of the fusing roller 111 to the target temperature 'Tt'.

The operations S10' through S130 will first be described. In operation S10', the controller 120 determines whether a flag 'C_Temp_OK' is set to indicate that the surface temperature 'T' of the fusing roller 111, measured through the thermistor 115 of the sensor unit 114, is higher than the printing temperature of approximately 180° C., which is the target temperature 'Tt' in this embodiment. In the initial stage when the flag 'C_Temp_OK' is not set, the operation S20' is performed next.

In operation S20', if there is no flag 'C_Temp_OK' set as a result of the determination in S10', the controller 120 determines whether the current time 't', counted through the timer 130, exceeds a first temperature control period '$t_{01}$' stored in the memory 125, to determine whether it is the first temperature control period '$t_{01}$'.

If it is the first temperature control period '$t_{01}$' as a result of the determination in S20', the controller 120 clears the current time 't' to '0' and re-starts the time counting in operation S30', and in operation S40', detects the surface temperature 'T' of the fusing roller 111 through the thermistor 115 of the sensor unit 114 to determine whether the surface temperature 'T' of the fusing roller 111 is lower than the printing temperature 180° C. plus a certain amount, for example, lower than the printing temperature 180° C. plus approximately 2° C.

As described above, the surface temperature 'T' of the fusing roller 111 is compared with a temperature which is a certain amount higher than the printing temperature (180° C.) instead of the printing temperature 180° C. itself. This is in light of the fact that a large temperature drop occurs in the initial stage of the printing, usually during the printing on the first page, when the fusing roller 111 is not completely heated yet. Accordingly, the fusing roller 111 is heated to a certain degree higher than the target temperature 'Tt', i.e., the printing temperature 180° C.

If the surface temperature 'T' of the fusing roller 111 is lower than the target temperature 'Tt' plus a certain amount, such as 182° C., the controller 120 determines whether the 'OFF time', counted through the timer 130, is longer than the first minimum power cutoff time 'Min OFF-time1' in operation S50'.

Although setting the 'Min OFF-time1' to a rather small value is more helpful for the surface temperature 'T' of the fusing roller 111 to reach the target temperature 'Tt' rapidly, in consideration of overshoot phenomenon, the 'Min OFF-time1' is set to an adequate value so that the temperature gap between the heated aluminum cylinder and the rubber layer 111*a* can be maintained below a certain degree.

If the 'OFF time' is shorter than the 'Min OFF-time1' as a result of the determination in S50', the controller 120 cuts off the power supply of the AC power supply 118 to the heater 112 in operation S60', and if the 'OFF time' is longer than the 'Min OFF-time1', the controller 120 determines whether the 'ON time', counted through the timer 130, is shorter than the first maximum power supply time 'Max ON-time' in operation S70'.

The 'Max ON-time1' is set in an appropriate range such that temperature increase and overshoot of the fusing system 100 can be maintained within an allowable range which does not affect the normal operation of the fusing system 100, with the continuous heating as much as the 'Max ON-time1'.

If the 'ON time' is shorter than the 'Max ON-time1' as a result of the determination in operation S70', the controller 120 controls the AC power supply 118 to supply power to the heater 112 in operation S80', and if the 'ON time' is longer than the 'Max ON-time1', the controller 120 cuts off power supply of the AC power supply 118 to the heater 112 in operation S60'.

While the AC power supply 11 supplies or cuts off power supply to the heater 112 in operation S80' or S60', the controller 120 moves to operation S20' and waits for the current time 't', counted through the timer 130, to reach the first temperature control period '$t_{01}$'.

If the surface temperature 'T' of the fusing roller 111 is higher than the printing temperature 180° C. plus a certain amount, for example, if the surface temperature 'T' is higher than 182° C. (printing temperature 180° C. plus 2° C.) as a result of the determination in operation S40', the controller 120 determines whether the 'ON time' is shorter than the first minimum power supply time 'Min ON-time1' in operation S90'.

The 'Min ON-time1' is set appropriately so that the surface temperature 'T' of the fusing roller 111 does not rise beyond a predetermined allowable temperature range even by heating at the printing temperature.

If the 'ON time' is longer than the first minimum power supply time 'Min ON-time1' as a result of the determination in operation S90', the controller 120 cuts off the power supply of the AC power supply 118 to the heater 112 in operation S100'.

If the 'ON time' is shorter than the 'Min ON-time1' as a result of the determination in operation S90', the controller 120 determines whether the surface temperature 'T' of the fusing roller 111 is lower than a maximum allowable temperature 'T_lim' in operation S10.

If the surface temperature 'T' of the fusing roller 111 is lower than 'T_lim' as a result of the determination in operation S110, the controller 120 controls the AC power supply 118 to continuously supply power to the heater 112 in operation S120.

If the surface temperature 'T' of the fusing roller 111 is higher than 'T_lim' as a result of the determination in operation S110, the controller 120 cuts off power supply of the AC power supply 118 to the heater 112 in operation S100'.

After that, the controller 120 in operation S130 sets a flag 'C_TEMP_OK', which indicates that the surface temperature 'T' of the fusing roller 111 exceeds the target temperature 'Tt'.

As a result, the controller 120 completes the operations S10' through S130 to increase the surface temperature 'T' of the fusing roller 111 to the target temperature 'Tt', and moves on to operations S140 through S230 to maintain the target temperature 'Tt'.

The operations to maintain the surface temperature 'T' of the fusing roller 111 at the target temperature 'Tt' such as the printing temperature of 180° C. will now be described. If the flag 'C_Temp_OK' is set in operation S10', or after completing the operation S130, the controller 120 in operation S140 determines whether the current time 't', counted through the timer 130, exceeds the second temperature control period '$t_{02}$' stored in the memory 125, to determine whether it is the second temperature control period '$t_{02}$' or not. The second temperature control period '$t_{02}$' may or may not be identical to the first temperature control period '$t_{01}$'. However, for convenience of explanation, the second temperature control period '$t_{02}$' is identical to the first temperature control period '$t_{01}$'.

If operation S140 determines the second temperature control period '$t_{02}$' as a result of the determination in operation S140, the controller 120 clears the current time 't' to '0' and re-starts time counting in operation S150, and detects in operation S160 the surface temperature 'T' of the fusing roller 111 through the thermistor 115 to determine whether the surface temperature 'T' of the fusing roller 111 is lower than the target temperature 'Tt' (such as the printing temperature 180° C.).

If the surface temperature 'T' of the fusing roller 111 is lower than the target temperature 'Tt' as a result of the determination in operation S160, the controller 120 determines in operation S170 whether the heater power cutoff time 'OFF time', counted through the timer 130, is longer than the second minimum power cutoff time 'Min OFF-time2' stored in the memory 125. The 'Min OFF-time2' may be identical to the 'Min OFF-time1', or longer.

If the 'OFF time' is shorter than the 'Min OFF-time2' as a result of the determination in S170, the controller 120 cuts off the power supply of the AC power supply 118 to the heater 112 in operation S180, and if the 'OFF time' is longer than the 'Min OFF-time2', the controller 120 determines whether the 'ON time', counted through the timer 130, is shorter than the 'Max ON-time2' in operation S190. The 'Max ON-time2' may be identical to the 'Max ON-time1' or shorter.

If the 'ON time' is shorter than the maximum power supply time 'Max ON-time2' as a result of the determination in operation S190, the controller controls the AC power supply 118 to supply power to the heater 112 in operation S200, and if the 'On time' is longer than the 'Max ON-time2', the controller 120 cuts off the power supply of the AC power supply 118 to the heater 112 in operation S180.

While the AC power supply 118 supplies or cuts off the power supply to the heater 112 in operation S200 or S180, the controller 120 moves to the operation S140 and waits for the current time 't', counted through the timer 130, to reach the second temperature control period '$t_{02}$'.

If the surface temperature 'T' of the fusing roller 111 is higher than the target temperature 'Tt', (for example, higher than the printing temperature 180° in this embodiment) as a result of the determination in operation S160, the controller 120 in operation S210 determines whether the 'ON time' is shorter than the 'Min ON-time2'. The 'Min ON-time2' may be to identical to the 'Min ON-time1', although this is not necessary.

If the 'ON time' is longer than the 'Min ON-time2' as a result of the determination in operation S210, the controller 120 cuts off power supply of the AC power supply 118 to the heater 112 in operation S180.

If the 'ON time' is shorter than the 'Min ON-time2' as a result of the determination in operation S210, the controller 120 determines whether the surface temperature 'T' of the fusing roller 111 is lower than the maximum allowable temperature range 'T_lim' in operation S220.

If the surface temperature 'T' of the fusing roller 111 is lower than 'T_lim' as a result of the determination in operation S220, the controller 120 controls the AC power supply 118 to continuously supply power to the heater 112 in operation S230.

If the surface temperature 'T' of the fusing roller 111 is higher than 'T_lim' as a result of the determination in operation S220, the controller 120 cuts off power supply of the AC power supply 118 to the heater 112 in operation S180.

While the AC power supply 118 supplies or cuts of power to the heater 112 in operations S230 or S180, the controller 120 moves to operation S140 and waits for the current time 't', counted through the timer 130, to reach the second temperature control period '$t_{02}$'.

If the current time 't' reaches the second temperature control period '$t_{02}$' in operation S140, the controller 120 repeats the following operations S150 through S230.

The timer 130 calculates the 'ON time' in which the AC power supply 118 constantly supplies power to the heater 112, and the 'OFF time' in which the AC power supply 118 constantly cuts off power supply to the heater 112, and clears the respective times to '0' when the heater power switches on or off. In other words, the 'OFF time' is cleared to '0' upon the power cutoff during the constant power supply to the heater 112, while the 'ON time' is cleared to '0' upon power supply to the heater 112 during the power cutoff.

Figure 10:
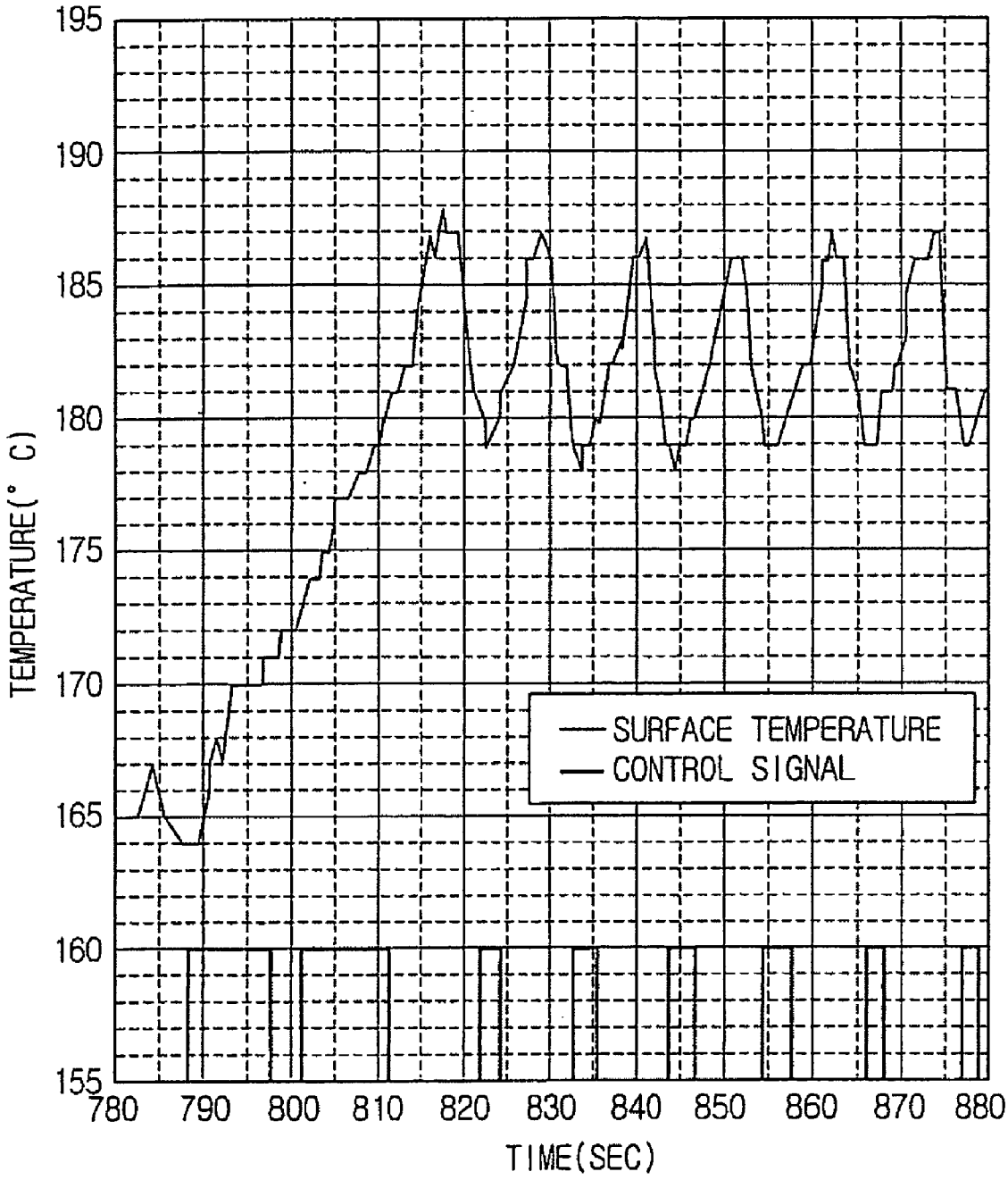
FIG. 10 is a graph illustrating the relationship between the surface temperature 'T' of the fusing roller and a drive control signal of the heater, the surface temperature 'T' and the drive control signal being obtained from experiments in which the temperature control method according to the second embodiment as shown in FIG. 9 is applied in a color printer.

FIG. 10 shows a graphical representation of the relationship between the surface temperature 'T' of the fusing roller 111 and the driving control signal of the heater 112, which is obtained by experiment on a color printer (i.e., SAMSUNG™ CLP-500 model) adopting the fusing system 100 and temperature control method according to the second embodiment of the present invention.

In an experiment, the control specification of the SAMSUNG™ CLP-500 model includes the target temperature 'Tt' (printing temperature) as 180° C., the maximum allowable temperature range 'T_lim' as 195° C., the temperature drop during the paper pass through the fusing roller 111 as 10° C., and an allowable ripple range of upper and lower limits of temperature waves as 4° C. According to an embodiment of the present invention, the first and second temperature control periods '$t_{01}$', '$t_{02}$' are both 0.9 seconds, the first maximum power supply time 'Max ON-time1' is 10.8 seconds, the second maximum power supply time 'Max ON-time2' is 8.1 seconds, the first and second minimum power supply times 'Min ON-time1', 'Min ON-time2' are 2.7 seconds, respectively, the first minimum power cutoff time 'Min OFF-time1' is 2.7 seconds, and the second minimum power cutoff time 'Min OFF-time2' is 6.3 seconds, and these values are input in the memory 125.

As shown in FIG. 10, after experiment, the surface temperature 'T' of the fusing roller changed between 188° C. and 178° C., the temperature drop upon paper pass through the fusing roller 111 was 9° C., the ripple range of the upper limit of temperature waves was in a 2° C. interval between 188° C. and 186° C., and the ripple range of the lower limit of temperature waves was in a 1° C. interval between 179° C. and 178° C., all of which satisfy the control specification of the color printer.

FIG. 10 shows that the 'Max ON-time1' and the 'Min OFF-time1' were repeated between 10.8 seconds and 2.7 seconds for the duration when the surface temperature 'T' of the fusing roller 111, being lower than the printing temperature, was heated to the printing temperature, and upon reaching of the surface temperature 'T' to the printing temperature, then 'Min ON-time1' was used. After the surface temperature 'T' of the fusing roller 111 reached the printing temperature, power was supplied for the duration longer than 'Min ON-time2' for approximately three times in the printing temperature maintaining stage, and as the surface temperature 'T' was stabilized, power was supplied only for the duration of 'Min ON-time2' according to the paper feeding period, for example, in every 11 seconds. As described above in the first embodiment of the present invention, the first and the second temperature control periods '$t_{01}$', '$t_{02}$' can be set, respectively, to 'Min ON-time1 and Min ON-time2'or 'Min OFF-time1 and Min OFF-time2', whichever is smaller, values equal to or smaller than both, or common divisors of both. Additionally, the first and the second temperature control periods '$t_{01}$', '$t_{02}$' can be set to common divisors of the paper feeding period and the above-mentioned values. In this experiment, the greatest common divisor 0.9 seconds of 2.7 seconds and 6.3 seconds was used as the temperature control period.

Although the above embodiment depicts a particular example of the fusing system 100 and temperature control method thereof in which the surface temperature 'T' of the fusing roller 111 is controlled with reference to a single target temperature 'Tt', this is only for the purpose of example, and therefore, a variety of variations are also possible. For example, control can be performed based on two temperatures, such as the printing standby temperature of approximately 165° C. and the printing temperature of approximately 180° C. In this example, the controller 120 may control the surface temperature 'T' of the fusing roller in accordance with the print standby operation of heating the surface temperature 'T' of the fusing roller 111 to the printing standby temperature or slightly higher and maintaining the printing standby temperature when reached, and the printing operation of heating the surface temperature 'T' of the fusing roller 111 to the printing temperature or slightly higher and maintaining the printing temperature when reached. The first and the second temperature control periods '$t_{01}$', '$t_{02}$', 'Max ON-time1, 'Max ON-time2', 'Min ON-time1', 'Min ON-time2', and 'Min OFF-time1, Min OFF-time2' can be preset suitably for the respective operations and stored in the memory 125, and therefore, the surface temperature 'T' of the fusing roller 111 can be controlled by appropriately using the stored value of the memory 125.

Embodiment 3

Figure 11:
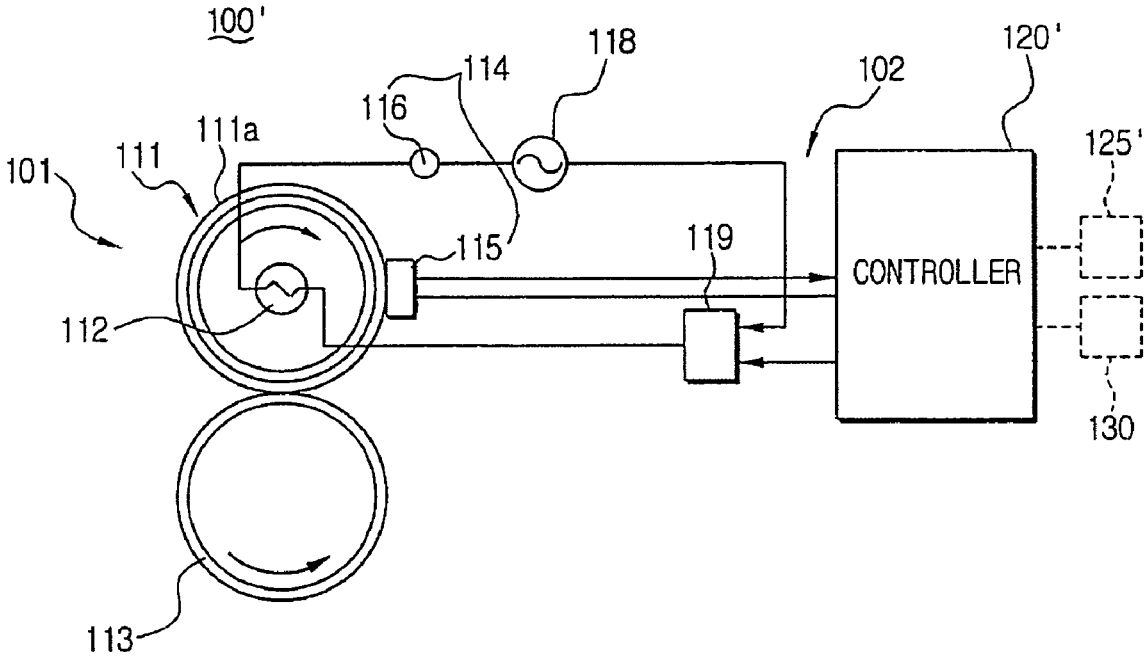
FIG. 11 is a schematic view of a fusing system of an image forming apparatus according to a third embodiment of the present invention.

FIG. 11 schematically shows a fusing system 100' which is applied to an electrophotographic image forming apparatus such as a laser printer, a copier or a facsimile machine, according to a third embodiment of the present invention.

The fusing system 100' according to the third embodiment is almost identical in structure with the fusing system 100 of the first embodiment which was described with reference to FIG. 7. A difference between the first and the third embodiments is that a controller 120' of the third embodiment controls the surface temperature 'T' of the fusing roller 111 by using not only the maximum power supply time 'Max ON-time', the minimum power supply time 'Min ON-time', and the minimum power cutoff time 'Min OFF-time', but also using the maximum power cutoff time 'Max OFF-time'. Accordingly, the differences will be described, while the construction thereof will be generally omitted for the sake of brevity.

The controller 120' includes a timer 130 to count time, and a memory 125' to store information such as a target temperature 'Tt' of the surface temperature 'T' of the fusing roller 111, the temperature control period '$t_0$', the maximum power supply time 'Max ON-time', the minimum power supply time 'Min ON-time', and the minimum power cutoff time 'Min OFF-time', and also, the maximum power cutoff time 'Max OFF-time'.

The controller 120' controls such that the heater 112 is turned on and off in accordance with the 'Max ON-time' and the 'Min OFF-time' in every temperature control period '$t_0$' until the surface temperature 'T', detected through the thermistor 115 of the sensor unit 114, reaches the target temperature 'Tt' such as the printing standby temperature of approximately 165° C. or the printing temperature of approximately 180° C., and the heater 112 is turned on and off in accordance with the 'Min ON-time' and the 'Max OFF-time' in every temperature control period '$t_0$' after the surface temperature 'T' reaches the target temperature 'Tt'.

If the surface temperature 'T' of the fusing roller 111 is lower than the target temperature 'Tt', the turning on and off of the heater 112 is performed in the same way as described in the first embodiment (FIG. 7) in accordance with the 'Max ON-time' and the 'Min OFF-time' in every temperature control period '$t_0$'. Therefore, this feature will not be described in detail.

If the surface temperature 'T' of the fusing roller 111 is higher than the target temperature 'Tt', and if the heater power supply time 'ON-time' of the AC power supply 118 does not exceed the 'Min ON-time', the controller 120', as in the fusing system 100 according to the first embodiment (FIG. 7), continue power supply to the heater 112 as for the 'Min ON-time'.

However, if the 'ON-time' of the AC power supply 118 exceeds the 'Min ON-time', the controller 120' determines if the 'OFF time' of the AC power supply 118 exceeds the 'Max OFF-time', and if so, supplies power to the heater 112. If the 'OFF time' does not exceed the 'Max OFF-time', the controller 120' cuts off power supply to the heater 112.

As a result, even when the surface temperature 'T' of the fusing roller 111 is higher than the target temperature 'Tt', because the heater 112 is turned on at least in accordance with the 'Max OFF-time', sufficient heat can be provided to the fusing roller 111 and therefore, the temperature gap between the aluminum cylinder and the rubber layer 11*a* due to temperature drop at the aluminum cylinder is restricted below a predetermined limit. Also, even when the printer stays in the waiting mode for a long time for the next printing operation or the data transmission, fusing with insufficient heat can be prevented.

The 'Max OFF-time' is equal to, or greater than the time which is required for the temperature to drop from the upper limit to the lower limit of the allowable temperature range of the target temperature 'Tt'. For example, when the target temperature 'Tt' is 180° C. and the allowable temperature range of the target temperature 'Tt' is ±5° C., the 'Max OFF-time' is set to be equal to, or greater than the time which is required for the temperature to drop from 185° C. to 175° C.

After the surface temperature 'T' of the fusing roller 111 reaches the target temperature 'Tt', and while controlling the heater 112 to turn on and off in accordance with the 'Min ON-time' and the 'Max OFF-time' in every temperature control period '$t_0$', the controller 120' may turn off the heater 112, irrespective of the 'Min ON-time' and the 'Max OFF-time', if the surface temperature 'T' exceeds the predetermined temperature limit 'T_lim'.

As described above, when the surface temperature 'T' of the fusing roller 111 is lower than the target temperature 'Tt' in the fusing system 100' according to the third embodiment of the present invention, the heater 112 is repeatedly turned on and off in accordance with the 'Max ON-time' and the 'Min OFF-time' in every temperature control period '$t_0$', and therefore, temperature gap between the aluminum cylinder and the rubber layer 11*a* can be restricted to below a predetermined level, and temperature can reach the target temperature 'Tt', rapidly. Meanwhile, when the surface temperature 'T' of the fusing roller 111 is higher than, or in the neighborhood of the target temperature 'Tt', the heater 112 is turned on and off in accordance with the 'Min ON-time', the 'Max OFF-time', and 'T_lim' in every temperature control period '$t_0$'. Accordingly, the temperature gap between the aluminum cylinder and the rubber layer 111*a* can be restricted to below a predetermined level, and also, the surface temperature 'T' of the fusing roller 111 can be maintained at the target temperature 'Tt' even when the printer stays in the waiting mode for the next printing operation or data transmission for a long time.

The temperature control method of the fusing system 100' for use in an image forming apparatus constructed in accordance with the third embodiment of the present invention will now be described below with reference to FIG. 12.

First, with power on at the fusing system 100', as shown in FIG. 11, the controller 120' in operation S10" determines whether the current time 't', counted through the timer 130, exceeds the temperature control period '$t_0$' to determine whether it is the temperature control period '$t_0$' stored in the memory 125'.

If it is the temperature control period '$t_0$' as a result of the determination in operation S10", the controller 120' clears the current time 't' to '0' and re-starts time counting in operation S20", and detects in operation S30" the surface temperature 'T' of the fusing roller 111 to determine whether the surface temperature 'T' of the fusing roller 111 is lower than the target temperature 'Tt'. Hereinbelow, the printing temperature of approximately 180° C. will be described as the target temperature 'Tt' by way of one example.

If the surface temperature 'T' of the fusing roller 111 is lower than the printing temperature 180° C., which is the target temperature 'Tt' in this embodiment, as a result of the determination in operation S30", the controller 120' in operation S40" determines whether the heater power cutoff time 'OFF time', counted through the timer 130, is longer than the 'Min OFF-time' stored in the memory 125'. The 'OFF time' refers to a time duration in which the AC power supply 118 does not supply power to the heater 112.

If the 'OFF time' is shorter than the 'Min OFF-time' as a result of the determination in operation S40", the controller 120' in operation S50" cuts off the power supply of the AC power supply 118 to the heater 112, and if the 'OFF time' is longer than the 'Min OFF-time', the controller 120' in operation S60" determines whether the 'ON time', counted through the timer 130, is shorter than the 'Max ON-time'.

If the 'ON time' is shorter than the 'Max ON-time' as a result of the determination in operation S60", the controller 120' in operation S70" controls the AC power supply 118 to supply power to the heater 112, and if the 'ON time' is longer than the 'Max ON-time', the controller 120' in operation S50" cuts off power supply of the AC power supply 118 to the heater 112.

While the AC power supply 118 supplies or cuts off power supply to the heater 112 in operation S70" or S50", the controller 120' moves to the operation S10" and waits until the current time 't', counted through the timer 130, reaches the temperature control period '$t_0$'.

Meanwhile, if the surface temperature 'T' of the fusing roller 111 is higher than the printing temperature 180° C. as a result of the determination in operation S30", the controller 120' in operation S80" determines whether the 'ON time' of the AC power supply 118 is shorter than the 'Min ON-time'.

If the 'ON time' is shorter than the 'Min ON-time' as a result of the determination in operation S80", the controller 120' in operation S90" determines whether the surface temperature 'T' of the fusing roller 111 is shorter than the maximum temperature limit 'T_lim'.

If the surface temperature 'T' of the fusing roller 111 is lower than 'T_lim' as a result of the determination in S90", the controller 120' in operation S100" controls the AC power supply 118 to continue power supply to the heater 112.

If the surface temperature 'T' of the fusing roller 111 is higher than 'T_lim' as a result of the determination in S90", the controller 120' in operation S50" cuts off power supply of the AC power supply 118 to the heater 112.

If the 'ON time' is longer than the 'Min ON-time' as a result of the determination in operation S80", the controller 120' in operation S110'determines whether the 'OFF time' is longer than the 'Max OFF-time'. If the 'OFF time' is shorter than the 'Max OFF-time' as a result of the determination in operation S110', the controller 120' in operation S50" cuts off power supply of the AC power supply 118 to the heater 112. If the 'OFF time' is longer than the 'Max OFF-time' as a result of the determination in operation S110', the controller 120' repeats the operations after S90". While the AC power supply 118 supplies or cuts off power supply to the heater 112 in operation S100" or S50", the controller 120' moves to the operation S10" and waits for the current time 't', counted through the timer 130, to reach the temperature control period '$t_0$'. After that, when the current time 't' reaches the temperature control period '$t_0$' in operation S10", the controller 120' repeats the following operations S20" through S110'.

Although the above-described third embodiment depicts a particular example of the fusing system 100' and temperature control method thereof in which the surface temperature 'T' of the fusing roller 111 is controlled with reference to a single target temperature 'Tt' (such as the printing temperature of approximately 180° C.), this is only for the purpose of example, and therefore, variations are also possible. For example, control can be performed based on two temperatures, such as the printing standby temperature of approximately 165° C. and the printing temperature of approximately 180° C. In this example, the controller 120' may control the surface temperature 'T' of the fusing roller in accordance with: an initial heating operation of heating the surface temperature 'T' of the fusing roller 111 to the printing standby temperature or any suitable temperature in the neighborhood of the printing temperature; a print standby operation of maintaining the surface temperature 'T' of the fusing roller 111 to the printing standby temperature; a heating operation of heating to increase the surface temperature 'T' of the fusing roller 111 to the printing temperature or slightly higher; and a printing operation of maintaining the surface temperature 'T' of the fusing roller 111 at the printing temperature. Information for the respective operations such as 'Max ON-time', 'Min ON-time', 'Min OFF-time' and 'Max OFF-time' are stored in the memory 125' so that the controller 120' can control the surface temperature 'T' of the fusing roller 111 in the respective operations by appropriately using the stored values.

In the printing standby operation, in which there is no reason for sudden change in surface temperature 'T', such as paper passing through the fusing roller 111, the surface temperature 'T' decreases gradually, and therefore, the surface temperature 'T' is controlled using the 'Max OFF-time'. In other operations, the surface temperature 'T' may be controlled by appropriately changing, for example, by prolonging, the temperature control period '$t_0$'.

Embodiment 4

The fusing system 100' according to the fourth embodiment is similar in structure to the fusing system 100' of the third embodiment as described above. The third and the fourth embodiments differ in the temperature control method, which will now be discussed.

The temperature control method of the fusing system 100' for use in an image forming apparatus according to the fourth embodiment of the present invention will be described below with reference to FIG. 13.

Figure 13:
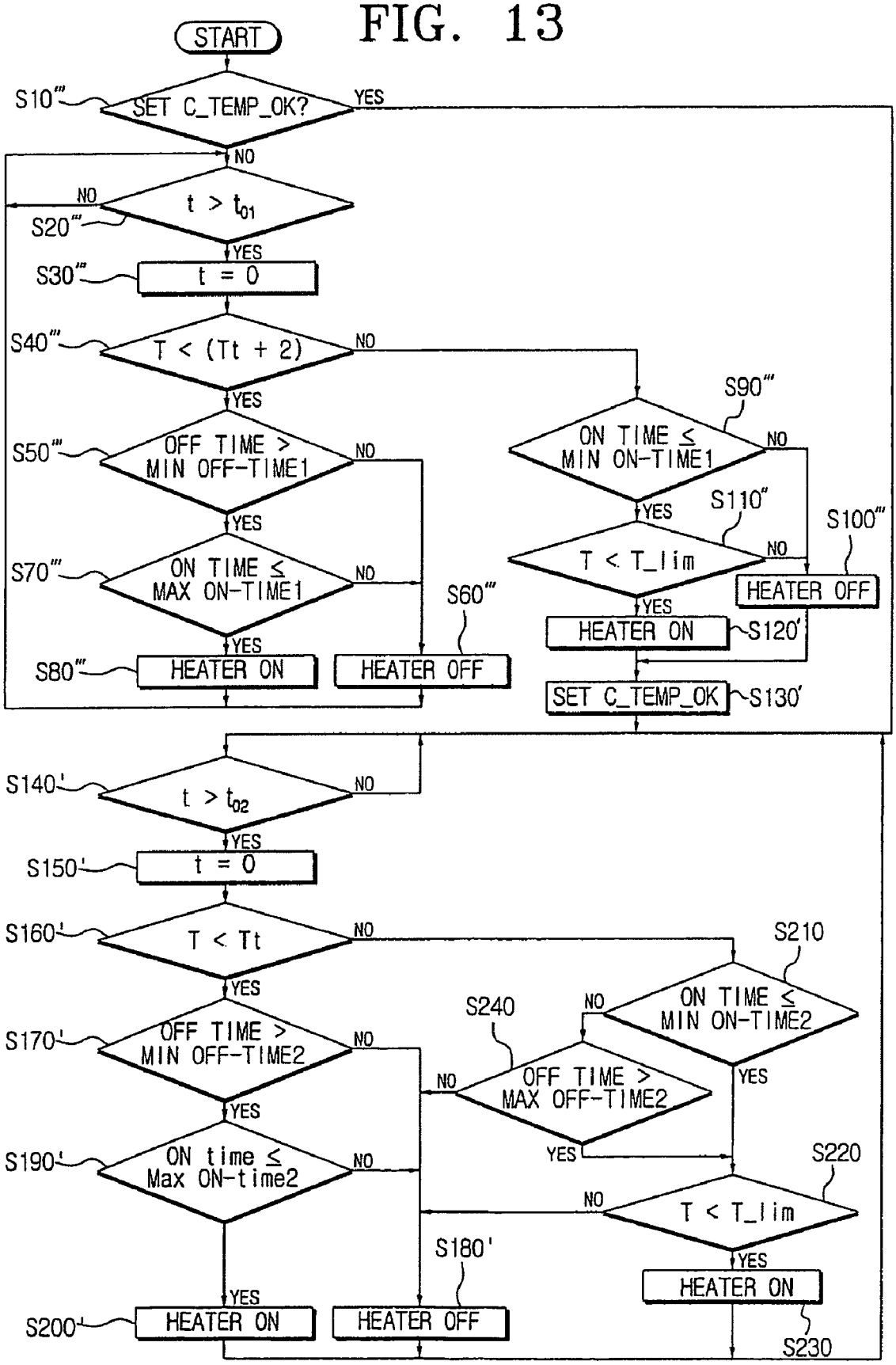
FIG. 13 is a flowchart illustrating exemplary operations of a temperature control method of a fusing system of an image forming apparatus according to a fourth embodiment of the present invention.

With the power of the fusing system 100' on, as shown in FIG. 13, the controller 120' performs operations S10''' through S130' of increasing the surface temperature 'T' of the fusing roller 111 from the atmospheric temperature to the target temperature 'Tt', such as the printing standby temperature of approximately 165° C. or the printing temperature of approximately 180° C., so as to be ready for the fusing operation at any time. The controller also performs the operations S140' through S240 of maintaining the surface temperature 'T' at the target temperature 'Tt'.

Figure 9:
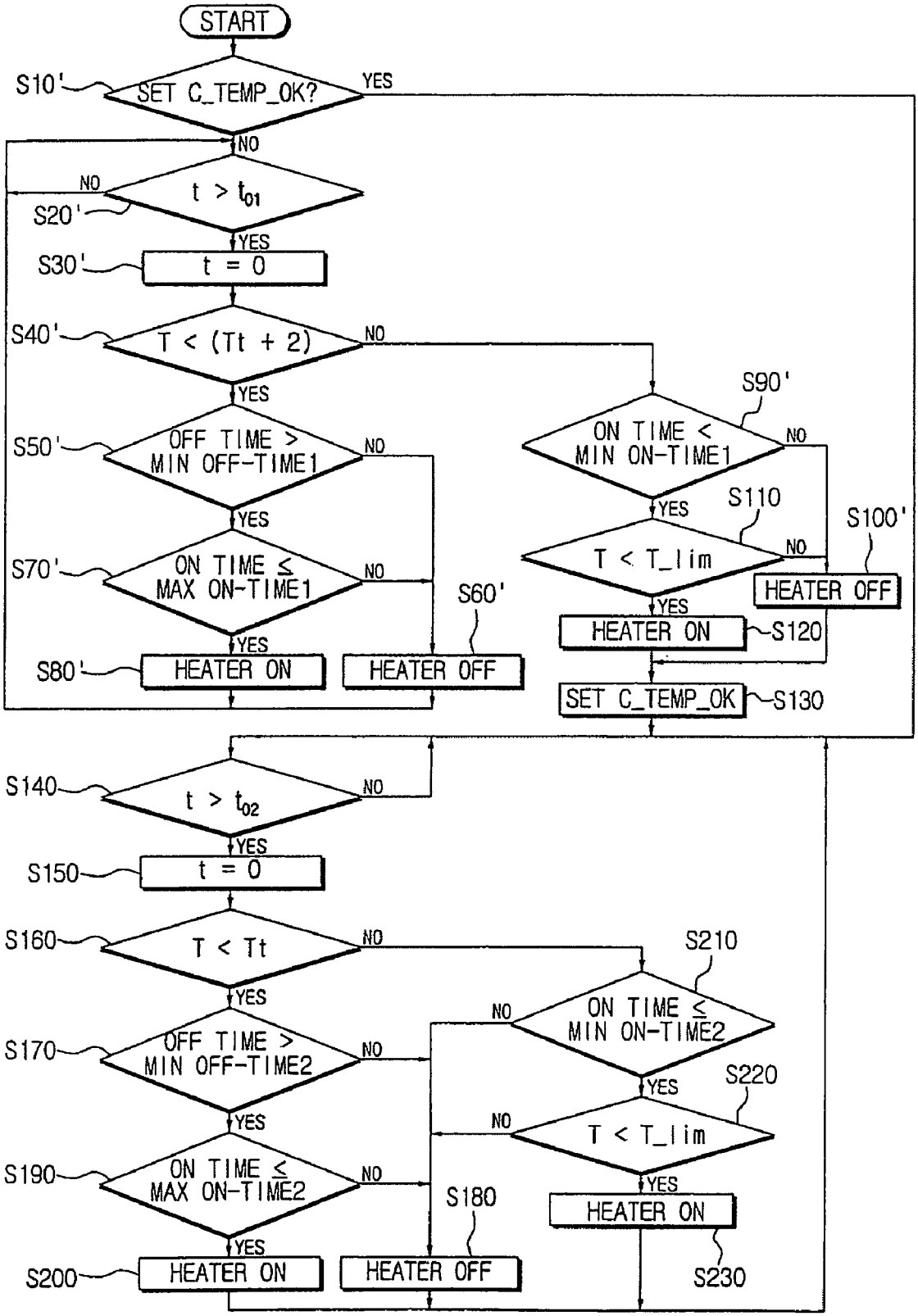
FIG. 9 is a flowchart illustrating exemplary operations of a temperature control method of a fusing system of an image forming apparatus according to a second embodiment of the present invention.

First, the operations S10''' through S130' are performed in a manner similar to the operations S10' through S130 of the second embodiment (FIG. 9). Here, the printing temperature of approximately 180° C. will be depicted as the target temperature 'Tt' by way of example.

Figure 12:
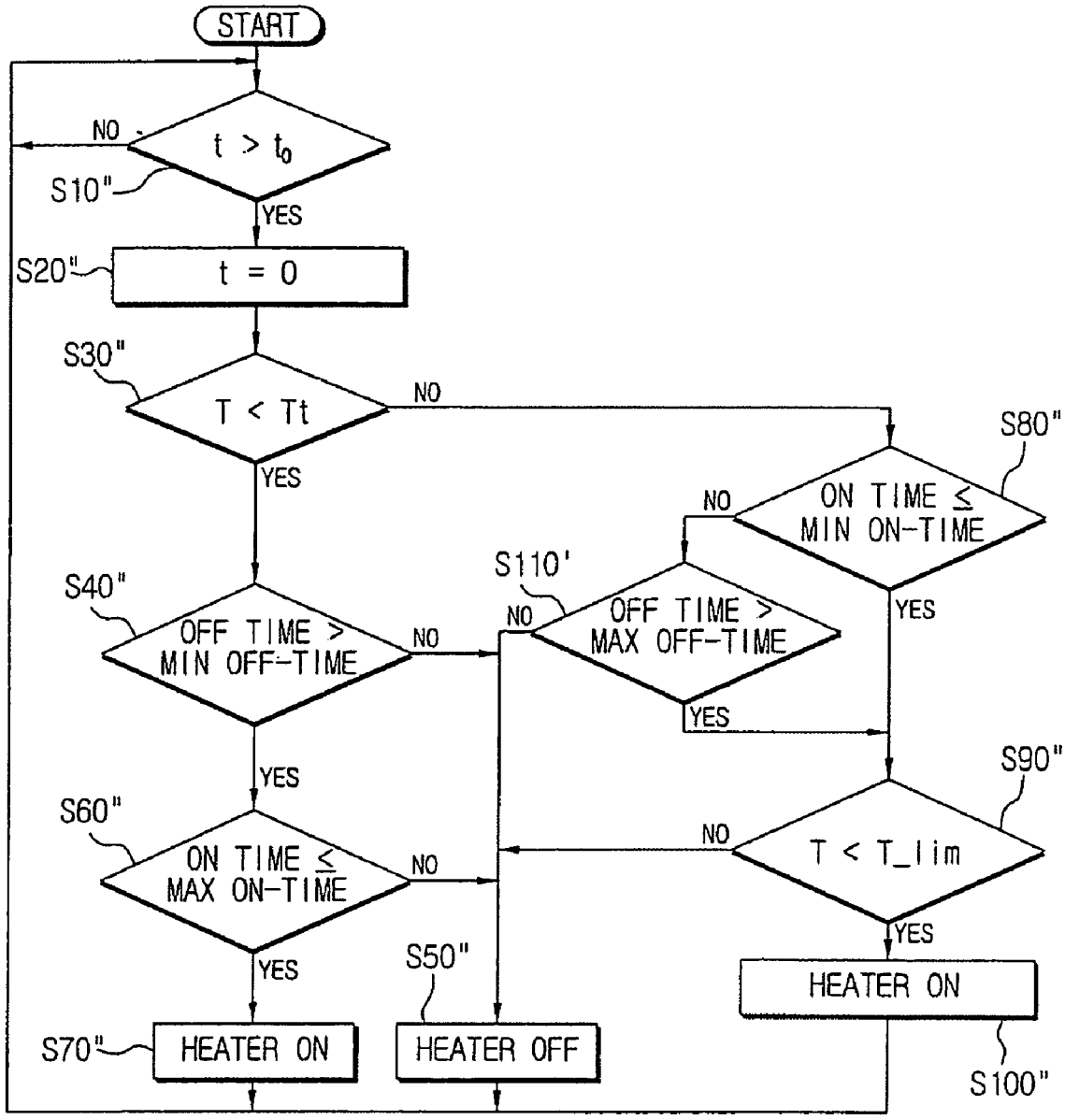
FIG. 12 is a flowchart illustrating exemplary operations of a temperature control method of the fusing system of FIG. 11.

Next, if a flag 'C_Temp_OK' is set in the operation S10''', or after completing the operation S130', the controller 120' performs the operations S140' through S240 to maintain the surface temperature 'T' at the printing temperature 180° C. as the target temperature 'Tt', in a manner similar to that of the operations S10'' through S110' of the third embodiment (FIG. 12). A difference is that operations S140' through S240 of the fourth embodiment use the second temperature control period '$t_{02}$', the second maximum power supply time 'Max ON-time2', the second minimum power supply time 'Min ON-time2', the second minimum power cutoff time 'Min OFF-time2' and the second maximum power cutoff time 'Max OFF-time2'.

Therefore, unlike the temperature control method of the second embodiment, the fourth embodiment uses the 'Max OFF-time' only in the operations S140' through S240 to maintain the surface temperature 'T' of the fusing roller 111 at the printing temperature 180° C., which is the target temperature 'Tt' in this embodiment. Even if the 'Max OFF-time' is applied in the temperature increasing operations S10''' through S130', it is not used in the actual temperature control.

Although the above-described fourth embodiment depicts a particular example of the fusing system 100' and temperature control method thereof in which the surface temperature 'T' of the fusing roller 111 is controlled with reference to a single target temperature 'Tt', such as the printing temperature of approximately 180° C. as in the second embodiment, one will appreciate that this is only for the purpose of example, and therefore, other variations are also applicable. For example, control can be performed based on two temperatures, such as a printing standby temperature of approximately 165° C. and the printing temperature of approximately 180° C. In this example, the controller 120' may control the surface temperature 'T' of the fusing roller in accordance with the print standby operation of heating the surface temperature 'T' of the fusing roller 111 to, or in the neighborhood of the printing standby temperature and maintaining the printing standby temperature when reached; and a printing operation of heating the surface temperature 'T' of the fusing roller 111 to the printing temperature or slightly higher and maintaining the printing temperature when reached. The first and the second temperature control periods '$t_{01}$', '$t_{02}$', 'Max ON-time1, Max ON-time2', 'Min ON-time1, Min ON-time2', OFF-time1, Min OFF-time2' and 'Max OFF-time2' can be preset suitably for the respective operations and stored in the memory 125', and therefore, the surface temperature 'T' of the fusing roller 111 can be controlled by appropriately using the stored value of the memory 125' in the respective operations.

As described above in a few exemplary embodiments, the fusing system and temperature control method thereof according to the present invention controls power supply to the heater in accordance with the 'Max ON-time', 'Min ON-time' and 'Min OFF-time', and therefore controls the surface temperature 'T' of the fusing roller. As a result, a change of the surface temperature 'T' of the fusing roller is minimized, and the surface temperature 'T' can be controlled stably. Also, power supply to the heater can be optimized.

Additionally, the fusing system and temperature control method thereof according to the embodiments of the present invention control the power supply to the heater in accordance with the 'Max ON-time', the 'Min ON-time', the 'Min OFF-time' and the 'Max OFF-time', and therefore controls the surface temperature 'T' of the fusing roller. As a result, the change in surface temperature 'T' is minimized, surface temperature 'T' can be stably controlled, power supply to the heater can be optimized, and also, fusing with insufficient heat can be prevented even when the printer waits for a long time for the next printing operation or data transmission.

Furthermore, because the surface temperature 'T' of the fusing roller can be controlled for a relatively long period, irregularities in the surface temperature 'T' of the fusing roller are minimized, and power consumption of the heater can be reduced.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A fusing system for use in an image forming apparatus, comprising:

a fusing unit comprising:

a fusing roller, and a heater, mounted inside the fusing roller, to heat the fusing roller; and a fusing temperature control unit comprising:

a sensor unit to sense a surface temperature 'T' of the fusing roller, a power supply unit to supply power to the heater, and a controller comprising a timer to count time, and a memory to store therein a preset target temperature 'Tt' of a surface of the fusing roller, a preset temperature control period '$t_0$' to determine a heater on and off time, a preset maximum power supply time 'Max ON-time' and a minimum power supply time 'Min ON-time' during which the power supply unit supplies power to the heater, and a minimum power cutoff time 'Min OFF-time' during which the power supply unit can cut off the power supply to the heater, the controller to control the surface temperature 'T' of the fusing roller by a control of the power supply to the heater in accordance with the target temperature 'Tt', the temperature control period '$t_0$', the 'Max ON-time', the 'Min ON-time' or the 'Min OFF-time'.

2. The fusing system according to claim 1, wherein the controller controls the heater to turn on and off in accordance with the 'Max ON-time' and the 'Min OFF-time' in each of the temperature control periods '$t_0$' before the surface temperature 'T' of the fusing roller reaches the target temperature 'Tt', and controls the heater to turn on and off in accordance with the 'Min ON-time' in each of the temperature control periods '$t_0$' after the surface temperature 'T' of the fusing roller reaches the target temperature 'Tt'.

3. The fusing system according to claim 2, wherein the 'Min ON-time' is set to a first heater power supply time of the power supply unit or shorter, or a second heater power supply time of the power supply unit or shorter, the first heater power supply time of the power supply unit to maintain the target temperature 'Tt' during the temperature control period '$t_0$' or longer, the second heater power supply time of the power supply unit to compensate for a temperature drop during a paper feeding period which is set to be longer than the temperature control period.

4. The fusing system according to claim 2, wherein the temperature control period '$t_0$' is set to one of:

the 'Min OFF-time' or the 'Min ON-time', whichever is smaller, or a value smaller than both of the 'Min OFF-time' and the 'Min ON-time', a common divisor of the 'Min OFF-time' and the 'Min ON-time', a divisor of the paper feeding period, and the 'Min OFF-time' or the 'Min ON-time', whichever is smaller, or the value smaller than both of the 'Min OFF-time' and the 'Min ON-time', and a common divisor of the 'Min OFF-time', the 'Min ON-time' and the paper feeding period.

5. The fusing system according to claim 2, wherein the controller controls the heater to turn off, irrespective of the 'Min ON-time', after the surface temperature 'T' reaches the target temperature 'Tt' and when the surface temperature 'T' exceeds a preset temperature limit 'T_lim'.

6. The fusing system according to claim 2, wherein the fusing roller comprises a rubber layer of a thickness on the surface such that the surface temperature 'T' increases when a time lapses after the power supply unit supplies the power to the heater.

7. The fusing system according to claim 6, wherein the 'Min OFF-time' is set to a value, and the set value corresponds to a time from the supply of power to the heater to a time when the surface temperature 'T' begins to rise.

8. The fusing system according to claim 2, wherein the memory of the controller further stores therein a maximum power cutoff time 'Max OFF-time' during which the power supply unit cuts off the power supply to the heater, and when the surface temperature 'T' of the fusing roller reaches the target temperature 'Tt', the controller controls the heater to turn on and off in accordance with the 'Min ON-time' and the 'Max OFF-time' in each of the temperature control periods '$t_0$'.

9. The fusing system according to claim 8, wherein the controller controls the heater to turn off, irrespective of the 'Min ON-time' and the 'Max OFF-time', when the surface temperature 'T' reaches the target temperature 'Tt' and exceeds a preset temperature limit 'T_lim'.

10. The fusing system according to claim 2, wherein the controller controls the surface temperature 'T' in accordance with a plurality of control processes, and each of the control process uses five values from among the temperature control period '$t_0$', the target temperature 'Tt', the 'Max ON-time', the 'Min ON-time', the 'Min OFF-time' and the 'Max OFF-time'.

11. A temperature control method of a fusing system for use in an image forming apparatus which comprises a fusing roller and a heater to heat the fusing roller, the temperature control method comprising:

detecting a surface temperature 'T' of the fusing roller in accordance with a temperature control period '$t_0$';

comparing the surface temperature 'T' with a preset target temperature 'Tt'; and turning the heater on and off in accordance with the comparing, in accordance with a maximum power supply time 'Max ON-time', and a minimum power supply time 'Min ON-time' or a minimum power cutoff time 'Min OFF-time'.

12. The temperature control method according to claim 11, wherein the turning on and off of the heater according to the 'Min ON-time' comprises:

comparing a heater power supply time with the 'Min ON-time'; and supplying power to the heater when the heater power supply time does not exceed the 'Min ON-time'.

13. The temperature control method according to claim 12, wherein the supplying of the power to the heater when the heater power supply time does not exceed the 'Min ON-time' comprises:

determining whether the surface temperature 'T' of the fusing roller exceeds a preset temperature limit 'T_lim'; and cutting off the power supply to the heater when the surface temperature 'T' exceeds the 'T_lim', even if the 'Min ON-time' has not elapsed yet.

14. A temperature control method of a fusing system for use in an image forming apparatus which comprises a fusing roller and a heater to heat the fusing roller, the temperature control method comprising:

detecting a surface temperature 'T' of the fusing roller in accordance with a temperature control period '$t_0$';

comparing the surface temperature 'T' with a preset target temperature 'Tt'; and turning the heater on and off in accordance with the comparing, in accordance with a maximum power supply time 'Max ON-time', a minimum power cutoff time 'Min OFF-time' or a minimum power supply time 'Min ON time', wherein the turning on and off of the heater comprises:

turning on and off the heater in accordance with the 'Max ON-time' and the 'Min OFF-time' when the surface temperature 'T' is lower than the target temperature 'Tt'; and turning on and off the heater in accordance with the 'Min ON-time' when the surface temperature 'T' is higher than the target temperature 'Tt'.

15. The temperature control method according to claim 14, wherein the turning on and off of the heater in accordance with the 'Max ON-time' and the 'Min OFF-time' comprises:

comparing a heater power supply time with the 'Max ON-time';

turning off the heater when the heater power supply time exceeds the 'Max ON-time';

comparing a heater power cutoff time with the 'Min OFF-time'; and cutting off the heater power supply when the heater power cutoff time does not exceed the 'Min OFF-time'.

16. The temperature control method according to claim 15, wherein the turning on and off of the heater in accordance with the 'Min ON-time' comprises:

comparing the heater power supply time with the 'Min ON-time';

supplying power to the heater when the heater power supply time does not exceed the 'Min ON-time';

comparing the heater power cutoff time with a preset maximum power cutoff time 'Max OFF-time' when the heater power supply time exceeds the 'Min ON-time'; and supplying power to the heater when the heater power cutoff time exceeds the 'Max OFF-time'.

17. The temperature control method according to claim 16, wherein the supplying of power to the heater when the heater power cutoff time exceeds the 'Max OFF-time' comprises:

comparing the surface temperature 'T' of the fusing roller with a preset temperature limit 'T_lim'; and cutting off the power supply to heater when the surface temperature 'T' exceeds the 'T_lim'.

18. The temperature control method according to claim 14, wherein the fusing roller comprises a rubber layer of a thickness on the surface such that the surface temperature 'T' increases when a time lapses after the power supply unit supplies the power to the heater.

19. The temperature control method according to claim 18, wherein the 'Min OFF-time' is set to a value, and the set value corresponds to a time from the supply of power to the heater to, or within the time when the surface temperature 'T' begins to rise.

20. A temperature control method of a fusing system for use in an image forming apparatus which comprises a fusing roller and a heater to heat the fusing roller, the temperature control method comprising:

detecting a surface temperature 'T' of the fusing roller in accordance with a temperature control period '$t_0$';

comparing the surface temperature 'T' with a preset target temperature 'Tt'; and turning the heater on and off in accordance with the comparing, in accordance with a maximum power supply time 'Max ON-time', a minimum power cutoff time 'Min OFF-time' or a minimum power supply time 'Min ON time', wherein the turning on and off of the heater according to the 'Min ON-time' comprises:

comparing a heater power supply time with the 'Min ON-time', and supplying power to the heater when the heater power supply time does not exceed the 'Min ON-time', wherein the 'Min ON-time' is set to a first heater power supply time or shorter, or a second heater power supply time or shorter, the first heater power supply time maintains the target temperature 'Tt' during the temperature control period '$t_0$' or longer, and the second heater power supply time compensates for a temperature drop during a paper feeding period which is set to be longer than the temperature control period '$t_0$'.

21. A temperature control method of a fusing system for use in an image forming apparatus which comprises a fusing roller and a heater to heat the fusing roller, the temperature control method comprising:

detecting a surface temperature 'T' of the fusing roller in accordance with a temperature control period '$t_0$';

comparing the surface temperature 'T' with a preset target temperature 'Tt'; and turning the heater on and off in accordance with the comparing, in accordance with a maximum power supply time 'Max ON-time', a minimum power cutoff time 'Min OFF-time' or a minimum power supply time 'Min ON-time', wherein the turning on and off of the heater according to the 'Min ON-time' comprises:

comparing a heater power supply time with the 'Min ON-time', and supplying power to the heater when the heater power supply time does not exceed the 'Min ON-time', wherein the temperature control period '$t_0$' is set to:

the 'Min OFF-time' or the 'Min ON-time', whichever is smaller, or a value smaller than both of the 'Min OFF-time' and the 'Min ON-time', a common divisor of the 'Min OFF-time' and the 'Min ON-time', a divisor of a paper feeding period and the 'Min OFF-time' or the 'Min ON-time', whichever is smaller, or the value smaller than both of the 'Min OFF-time' and the 'Min ON-time', or a common divisor of 'Min OFF-time', 'Min ON-time' and the paper feeding period.

22. A temperature control method of a fusing system for use in an image forming apparatus which comprises a fusing roller and a heater to heat the fusing roller, the control method comprising:

increasing a surface temperature 'T' of the fusing roller to a preset target temperature 'Tt';

maintaining the surface temperature 'T' at the target temperature 'Tt', wherein the increasing of the surface temperature 'T' to the target temperature 'Tt' comprises:

detecting the surface temperature 'T' according to a first temperature control period '$t_{01}$', comparing the detected surface temperature 'T' with a first temperature 'T1' which is equal to or higher than the target temperature 'Tt', turning on and off the heater in accordance with a first maximum power supply time 'Max ON-time1' and a first minimum power cutoff time 'Min OFF-time1' when the detected surface temperature 'T' is lower than the first temperature 'T1', and turning on and off the heater in accordance with a first minimum power supply time 'Min ON-time1' and maintaining the surface temperature 'T' at the target temperature 'Tt' when the detected surface temperature 'T' is higher than the first temperature 'T1'.

23. The temperature control method according to claim 22, wherein the turning on and off of the heater in accordance with the 'Max ON-time1' and the 'Min OFF-time1' comprises:

comparing a heater power supply time with the 'Max ON-time1';

turning off the heater when the heater power supply time exceeds the 'Max ON-time1';

comparing a heater power cutoff time with the 'Min OFF-time1'; and cutting off the power supply to the heater when the heater power cutoff time does not exceed the 'Min OFF-time1'.

24. The temperature control method according to claim 23, wherein the turning on and off of the heater in accordance with the 'Min ON-time1' comprises:

comparing the heater power supply time with the 'Min ON-time1'; and supplying power to the heater when the heater power supply time does not exceed the 'Min ON-time1'.

25. The temperature control method according to claim 24, wherein the supplying of the power to the heater when the heater power supply time does not exceed the 'Min ON-time1' further comprises:

determining whether the surface temperature 'T' of the fusing roller exceeds a preset temperature limit 'T_lim'; and cutting off the power supply to the heater if the surface temperature 'T' exceeds 'T_lim', irrespective of whether the 'Min On-time1' has elapsed.

26. The temperature control method according to claim 22, wherein the maintaining of the surface temperature 'T' at the target temperature 'T', comprises:

detecting the surface temperature 'T' in accordance with a second temperature control period '$t_{02}$';

comparing the detected surface temperature 'T' with the target temperature 'Tt';

turning on and off the heater in accordance with a second maximum power supply time 'Max ON-time2' and a second minimum power cutoff time 'Min OFF-time2' when the surface temperature 'T' is lower than the target temperature 'Tt'; and turning on and off the heater in accordance with a second minimum power supply time 'Min ON-time2' when the surface temperature 'T' of the fusing roller is higher than the target temperature 'Tt'.

27. The temperature control method according to claim 26, wherein the turning on and off of the heater in accordance with the 'Max ON-time2' and the 'Min OFF-time2' comprises:

comparing a heater power supply time with the 'Max ON-time2';

turning off the heater when the heater power supply time exceeds the 'Max ON-time2'; comparing the heater power cutoff time with the 'Min OFF-time2'; and cutting off the power supply to the heater when the heater power cutoff time does not exceed the 'Min OFF-time2'.

28. The temperature control method according to claim 27, wherein the turning on and off of the heater in accordance with the 'Min ON-time2' comprises:

comparing the heater power supply time with the 'Min ON-time2'; and supplying power to the heater when the heater power supply time does not exceed the 'Min ON-time2'.

29. The temperature control method according to claim 28, wherein the supplying of the power to the heater when the heater power supply time does not exceed the 'Min ON-time2' comprises:

determining whether the surface temperature 'T' exceeds a temperature limit 'T_lim'; and cutting off the power supply to the heater if the surface temperature 'T' exceeds 'T_lim', irrespective of whether the 'Min ON-time2' has elapsed.

30. The temperature control method according to claim 29, wherein the 'Min ON-time2' is set to a value, and the set value corresponds to a time from the power supply to the heater to, or within the time when the surface temperature 'T' of the fusing roller begins to rise.

31. The temperature control method according to claim 30, wherein the 'Min ON-time1' and the 'Min ON-time2' are identical.

32. The temperature control method according to claim 27, wherein the turning on and off of the heater in accordance with the 'Min ON-time2' comprises:

comparing the heater power supply time with the 'Min ON-time2';

supplying power to the heater when the heater power supply time does not exceed the 'Min ON-time2';

comparing the heater power cutoff time with a maximum power cutoff time 'Max OFF-time' when the heater power supply time exceeds the 'Min ON-time2'; and supplying power to the heater when the heater power cutoff time exceeds the 'Max OFF-time2'.

33. The temperature control method according to claim 32, wherein the supplying of the power to the heater when the heater power cutoff time exceeds the 'Max OFF-time' further comprises:

comparing the surface temperature 'T' with a temperature limit 'T_lim'; and cutting off the power to the heater when the surface temperature 'T' exceeds 'T_lim'.

34. A method of controlling a temperature of a fusing roller heated by a heater, comprising:

turning the heater on and off in accordance with a maximum power supply time to the heater and a minimum power cutoff time.

35. The method according to claim 34, wherein the turning the heater on and off in accordance with the maximum power supply time comprises:

determining whether a current power supply time to the heater is greater than the maximum power supply time; and cutting off the power supply to the heater if determined that the current power supply time is greater than the maximum power supply time.

36. A method of controlling a temperature of a fusing roller heated by a heater, comprising:

turning the heater on and off in accordance with a minimum power cutoff time during which power is not constantly supplied to the heater.

37. The method according to claim 36, wherein the turning the heater on and off in accordance with the minimum power cutoff time comprises:

determining whether a current power cutoff time to the heater is greater than the minimum power cutoff time; and cutting off the power supply to the heater if determined that the current power cutoff time is not greater than the minimum power cutoff time.

38. A method of controlling a temperature of a fusing roller heated by a heater, comprising:

turning the heater on and off in accordance with a minimum power supply time and a minimum power cutoff time to the heater.

39. The method according to claim 38, wherein the turning the heater on and off in accordance with the minimum power supply time comprises:

determining whether a current power supply time to the heater is greater than the minimum power supply time; and cutting off the power supply to the heater if determined that the current power supply time is greater than the minimum power supply time.

40. An apparatus, comprising:

a fuser to fuse an image on a recording medium;

a heater to heat the fuser;

a power supply to supply power to the heater; and a controller to control the supply of the power to the heater in accordance with a maximum power supply time to the heater, and a minimum power supply time to the heater or a minimum power cutoff time during which power is not constantly supplied to the heater.

41. The apparatus according to claim 40, wherein the fuser comprises:

an aluminum cylinder;

a rubber layer on the cylinder; and a non-stick coating layer on the rubber layer.

* * * * *

UNITED STATES PATENT AND TRADEMARK OFFICE

CERTIFICATE OF CORRECTION

PATENT NO. : 7,109,440 B2
APPLICATION NO. : 10/941945
DATED : September 19, 2006
INVENTOR(S) : Beom-ro Lee It is certified that error appears in the above-identified patent and that said Letters Patent is hereby corrected as shown below:

Column 26, Line 19, change " 'Min ON-time' " to --'Min ON-time',--.

Column 26, Line 44, change " '$t_{o'}$;" to --'$t_{o'}$;--.

Column 26, Line 51, change " 'Min ON time'," to --'Min ON-time',--.

Column 27, Line 50, change " 'Min ON time'." to --'Min ON-time',--.

Column 29, Line 20, change " 'Min On-time1' " to --'Min ON-time1',--.

Column 29, Line 23, change " 'T', " to --'Tt,--.

Signed and Sealed this

Twentieth Day of February, 2007

JON W. DUDAS
*Director of the United States Patent and Trademark Office*